US009029679B2

(12) United States Patent
Sakata et al.

(10) Patent No.: US 9,029,679 B2
(45) Date of Patent: May 12, 2015

(54) ELECTRONIC MUSICAL INSTRUMENT, TOUCH DETECTION APPARATUS, TOUCH DETECTING METHOD, AND STORAGE MEDIUM

(71) Applicant: Casio Computer Co., Ltd., Shibuya-ku, Tokyo (JP)

(72) Inventors: Goro Sakata, Tokyo (JP); Akira Ikeda, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 14/467,286

(22) Filed: Aug. 25, 2014

(65) Prior Publication Data

US 2015/0059557 A1 Mar. 5, 2015

(30) Foreign Application Priority Data

Aug. 29, 2013 (JP) ..... 2013-178347

(51) Int. Cl.
*G10H 3/00* (2006.01)
*G10H 1/34* (2006.01)
*G10H 1/02* (2006.01)

(52) U.S. Cl.
CPC . *G10H 1/344* (2013.01); *G10H 1/02* (2013.01)

(58) Field of Classification Search
USPC ..... 84/744
See application file for complete search history.

(56) References Cited

U.S. PATENT DOCUMENTS

| | | | | |
|---|---|---|---|---|
| 4,510,836 | A * | 4/1985 | Markowitz | 84/626 |
| 6,849,796 | B2 * | 2/2005 | Yamaguchi | 84/720 |
| 7,619,157 | B2 * | 11/2009 | Hirota | 84/658 |
| 8,766,081 | B2 * | 7/2014 | Sakata | 84/662 |
| 2005/0016369 | A1 * | 1/2005 | Sunako | 84/737 |

FOREIGN PATENT DOCUMENTS

| | | | |
|---|---|---|---|
| JP | 2005043553 | A | 2/2005 |
| JP | 3922225 | B2 | 5/2007 |

* cited by examiner

*Primary Examiner* — Jianchun Qin
(74) *Attorney, Agent, or Firm* — Holtz, Holtz, Goodman & Chick PC

(57) ABSTRACT

In a touch detection apparatus 50, the controller 51 predicts damper-on arrival time as time of arrival of generation of a damper-on event based on a period of time counted by a first counter 54 from when a second contact point 160*b* is turned off until when a first contact point 160*a* is turned off. The second counter 55 counts time to be compared to the damper-on arrival time. The comparator circuit 58 compares the time counted by the second counter 55 and the damper-on arrival time. If the time counted by the second counter 55 and the damper-on arrival time agree with each other, the comparator circuit 58 transmits a key release agreement signal triggering generation of a damper-on event to the controller 51. If the key release agreement signal is transmitted from the comparator circuit 58, the controller 51 executes control to generate a damper-on event.

16 Claims, 19 Drawing Sheets

FIG. 3

| | | | | | | | | | | | | | | | | | | | | |
|---|---|---|---|---|---|---|---|---|---|---|---|---|---|---|---|---|---|---|---|---|
| 0 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| 1 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| | | | | | ..... | | | | | | | | | | | | | | | |
| 81 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| 82 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| 83 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| 84 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| 85 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| 86 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| 87 | EV | ST2 | ST1 | ST0 | VC7 | VC6 | VC5 | VC4 | VC3 | VC2 | VC1 | VC0 | TC7 | TC6 | TC5 | TC4 | TC3 | TC2 | TC1 | TC0 |
| | EV | ST | | | VC | | | | | | | | TC | | | | | | | |

FIG. 4

| ST (STATUS) | STATUS | STATUS ADVANCE CONDITION | | | OPERATION FOR ADVANCE | ADVANCE TO STOPPING OPERATION IN THE CASE OF LOSS OF CONDITION | STATUS RESPONSIVE TO ENTRY OF CONDITION |
|---|---|---|---|---|---|---|---|
| | | FIRST CONTACT POINT | SECOND CONTACT POINT | OTHERS | | | |
| 0 | WAITING FOR KEY PRESS | 0 | | | to ST1 | — | |
| 1 | KEY PRESS BIAS TIME BEING COUNTED | | | ARRIVAL OF KEY PRESS BIAS TIME | to ST2 | to ST0 | |
| 2 | KEY PRESS VELOCITY MEASURED VALUE BEING COUNTED | | 0 | | to ST3 | to ST0 | COMPLETE KEY PRESS AND GENERATE NOTE-ON EVENT (DURING NOTE ON 2 ENABLE) |
| 3 | KEY PRESS CORRECTION TIME BEING COUNTED | | | ARRIVAL OF KEY PRESS ARRIVAL TIME | to ST4 EV=1 | to ST0 | COMPLETE KEY PRESS AND GENERATE NOTE-ON EVENT |
| 4 | WAITING FOR KEY RELEASE | | 1 | | to ST5 | — | |
| 5 | KEY RELEASE BIAS TIME BEING COUNTED | | | ARRIVAL OF KEY RELEASE BIAS TIME | to ST6 | to ST4 | |
| 6 | KEY RELEASE VELOCITY MEASURED VALUE BEING COUNTED | 1 | | | to ST7 EV=1 | to ST1 (Mode0)<br>to ST4 (Mode1) | COMPLETE KEY RELEASE AND GENERATE NOTE-OFF EVENT (DURING NOTE OFF ENABLE) |
| 7 | KEY RELEASE CORRECTION TIME BEING COUNTED | | | ARRIVAL OF KEY RELEASE ARRIVAL TIME | to ST0 EV=1 | to ST1 (Mode0)<br>to ST4 (Mode1) | COMPLETE KEY RELEASE AND GENERATE DAMPER-ON EVENT |

ELECTRONIC MUSICAL INSTRUMENT, TOUCH DETECTION APPARATUS, TOUCH DETECTING METHOD, AND STORAGE MEDIUM

CROSS-REFERENCE TO RELATED APPLICATIONS

This application is based upon and claims the benefit of priority from the prior Japanese Patent Application No. 2013-178347, filed Aug. 29, 2013, and the entire contents of which are incorporated herein by reference.

BACKGROUND OF THE INVENTION

1. Field of the Invention

The present invention relates to an electronic musical instrument, a touch detection apparatus, a touch detecting method, and a storage medium.

2. Related Art

Velocity information indicative of the intensity of a sound generated by an electronic musical instrument such as an electronic piano has conventionally been detected as follows.

A first contact point and a second contact point are provided below each key of an electronic piano. The first and second contact points are turned on in positions in which a press amount (stroke) of the key differs from each other. A difference in time between on-timing of the first contact point and that of the second contact point is measured and velocity information is detected based on the resultant time difference. A musical sound of an intensity responsive to the velocity information is generated from a linked sound source.

An electronic piano such as one disclosed for example in Japanese Patent No. 3922225 has been put on the market in recent years that has three contact points below each key. This is intended to enable sound source control in the manner of damping of a piano with three contact points by adding one contact point in a position (intermediate stroke position) where a press amount becomes midway between those of conventional two contact points. For the convenience of description, these three contact points are called a first contact point, a second contact point, and a third contact point in the order in which a key is pressed down more deeply.

The aforementioned electronic piano with three contact points does not differ largely in structure from an electronic piano with two contact points in that velocity information is detected based on a difference in time between on-timing of the second contact point and that of the third contact point.

In the electronic piano with the three contact points, if the second contact is provided in a stroke position deeper than that of the conventional electronic piano with the two contact points, repetition action of a small amplitude in a deep stroke position can be detected like in an acoustic piano.

Like in the conventional electronic piano with two contact points, in the electronic piano with three contact points, timing of sound deadening is detected based on off-timing of the first contact point in a stroke position corresponding to a position in the conventional electronic piano. In the electronic piano with three contact points, sound deadening (turning on a damper) can be controlled using the first contact point and sound generation (touch strength and timing of starting sound generation) can be controlled using the second and third contact points.

Accordingly, if repetition of applying strokes continuously to the second and third contact points is made while the damper is off (released) in the electronic piano with three contact points, multiple musical sounds of the same pitch can be generated continuously and early. This enables reproduction of musical performance relating to repetition in the manner of an acoustic piano.

To achieve such performance relating to repetition, conventional two contact points should be increased to three contact points for one key. This involves many additional parts such as contacts (switches), interconnections, and diodes for a contact point matrix (switch matrix). This inevitably necessitates complication and cost increase. Hence, a conventional structure with only two contact points has been desired to achieve performance relating to repetition comparable to that achieved by an electronic piano with three contact points.

SUMMARY OF THE INVENTION

The present invention has been made in view of the aforementioned situation. It is an object of the present invention to achieve performance relating to repetition in an electronic musical instrument with a conventional structure with only two contact points comparable to that achieved by an electronic piano with three contact points.

In order to achieve this object, an electronic musical instrument according to one aspect of the present invention includes a touch detection apparatus that includes:

a keyboard with multiple keys that designate the tones of corresponding musical sounds to be generated; a first contact point provided for each of the keys, the first contact point being turned on if a press amount increases to a first value in response to key pressing action on this key, the first contact point being turned off if the press amount decreases to a value below the first value in response to key releasing action on the key;

a second contact point that is turned on if the press amount of the key increases further to a second value larger than the first value in response to the key pressing action, the second contact point being turned off if the press amount decreases to a value below the second value in response to the key releasing action;

a key press counter that counts a period of time from when the first contact point is turned on until when the second contact point is turned on in response to the key pressing action;

a note-on event generation unit, in response to turning on the second contact point, the note-on event generation unit generating a note-on event to instruct generation of a musical sound of a volume corresponding to the period of time counted by the key press counter and of a pitch corresponding to the pressed key;

a key release counter that counts a period of time from when the second contact point is turned off until when the first contact point is turned off in response to the key releasing action; and a note-off event generation unit, after elapse of time corresponding to a count value in the key release counter from turning off the first contact point, the note-off event generation unit generating a note-off event to instruct deadening of a musical sound of a pitch corresponding to the released key, the electronic musical instrument including a sound source that generates a musical sound and deadens a musical sound based on the note-on event and the note-off event generated by the touch detection apparatus.

BRIEF DESCRIPTION OF THE DRAWINGS

FIG. 3 shows the format of a counter memory in the touch detection apparatus of FIG. 2;

FIG. 4 shows a transition of a status flag (ST) in the hardware forming the touch detection apparatus according to the present embodiment;

DETAILED DESCRIPTION OF THE INVENTION

A touch detection apparatus according to an embodiment of the present invention is described below based on the drawings.

Figure 1:
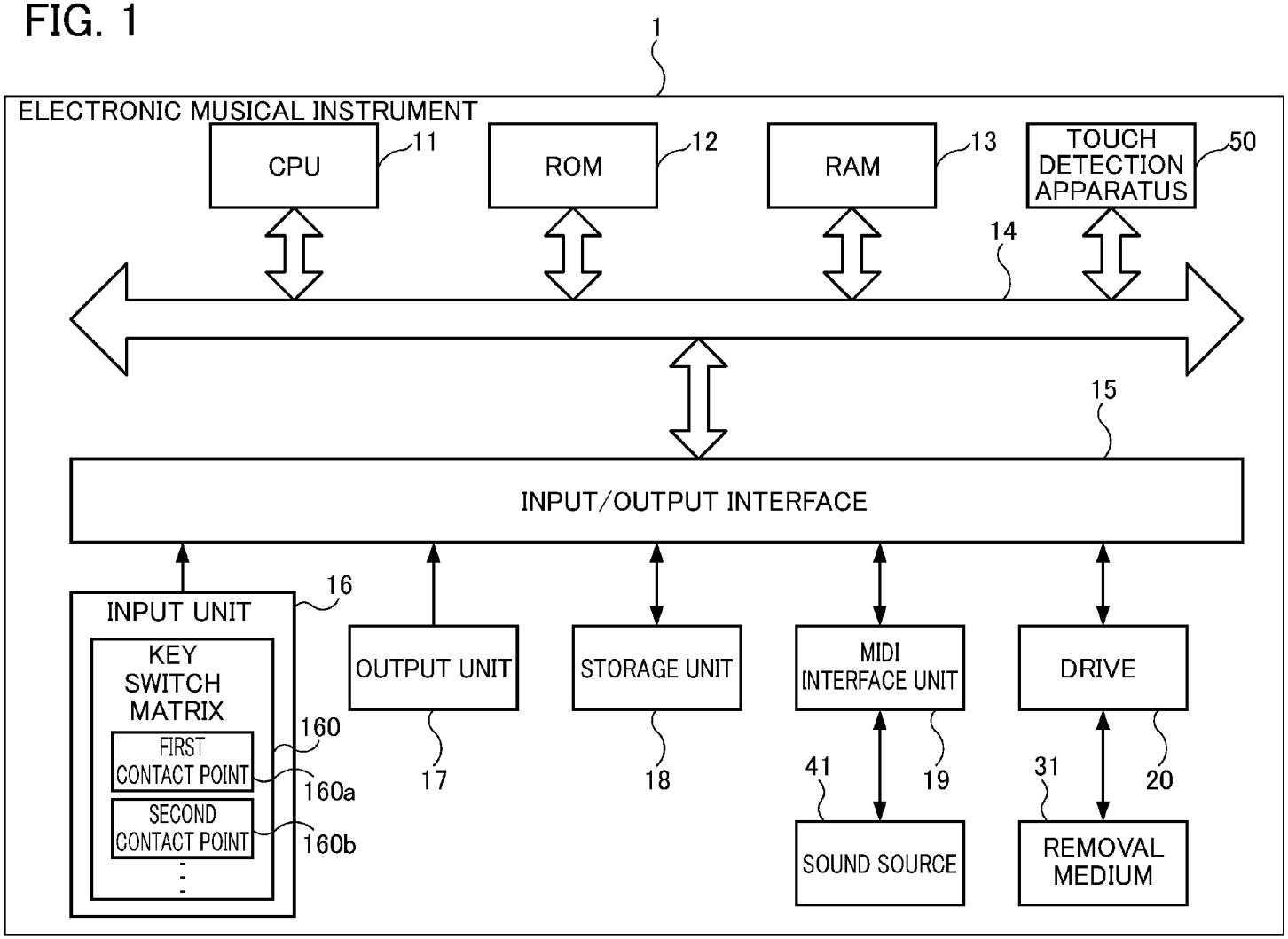
FIG. 1 is a block diagram showing a hardware structure of an electronic musical instrument to which a touch detection apparatus according to an embodiment of the present invention is applied.

FIG. 1 is a block diagram showing a hardware structure of an electronic musical instrument 1 to which a touch detection apparatus 50 according to the embodiment of the present invention is applied.

By referring to FIG. 1, the electronic musical instrument 1 includes a CPU 11, a ROM (read only memory) 12, a RAM (random access memory) 13, a bus 14, an input/output interface 15, an input unit 16, an output unit 17, a storage unit 18, an MIDI (musical instrument digital interface) interface unit 19, a drive 20, and the touch detection apparatus 50.

The CPU 11 performs various processes according to a program stored in the ROM 12 or a program loaded from the storage unit 18 to the RAM 13. As an example, the CPU 11 executes control to generate a sound and deaden a sound, specifically executes sound generation control and sound deadening control based on various events (described in detail later) transmitted from the touch detection apparatus 50.

The RAM 13 stores appropriate data and the like necessary for the CPU 11 to execute the various processes.

The CPU 11, the ROM 12, the RAM 13, and the touch detection apparatus 50 described later are connected to each other through the bus 14. The bus 14 further connects the input/output interface 15. The input/output interface 15 is connected to the input unit 16, the output unit 17, the storage unit 18, the MIDI interface unit 19, and the drive 20.

The input unit 16 includes an MIDI keyboard having multiple keys (88 keys, for example) to which sounds of corresponding types are associated. In the electronic musical instrument 1, the sounds associated with the corresponding keys are identified with note numbers. The touch detection apparatus 50 described later detects key pressing action and key releasing action on these keys.

More specifically, the input unit 16 includes a key switch matrix 160 with a first contact point 160*a* and a second contact point 160*b* connected in a matrix that are provided for each of the keys and are turned on in turn in response to key pressing action.

The key switch matrix 160 detects the first or second contact point 160*a* or 160*b* having been turned on in response to a common switch input signal (KC) transmitted from the touch detection apparatus 50. Then, the key switch matrix 160 transmits a first contact point on signal indicative of the first contact point 160*a* having been turned on or a second contact point on signal indicative of the second contact point 160*b* having been turned on to the touch detection apparatus 50.

The key switch matrix 160 determines that the second and first contact points 160*b* and 160*a* have been turned off in this order in response to key releasing action started in a status where a key is pressed down completely. Then, the key switch matrix 160 transmits a first contact point off signal indicative of the first contact point 160*a* having been turned off or a second contact point off signal indicative of the second contact point 160*b* having been turned off to the touch detection apparatus 50.

The input unit 16 further includes a switch for entry of information of various types. The input unit 16 outputs the information of various types entered by a user to the CPU 11.

The output unit 17 includes a display, a speaker, a D/A converting circuit, and the like. The output unit 17 is to output images and voices.

The storage unit 18 is formed for example of a hard disk or a dynamic random access memory (DRAM). The storage unit 18 stores various programs for control of the electronic musical instrument 1.

The MIDI interface unit 19 is an interface connecting a sound source 41 to generate a musical sound and the CPU 11 functioning as a sound generation control unit. Waveform data about musical sounds corresponding to the tones of multiple types of musical sounds is stored in advance in the sound source 41. The waveform data is read repeatedly at a speed responsive to a sound pitch designated in response to press of any of the multiple keys of the input unit 16, thereby generating and outputting a musical sound waveform.

Where appropriate, a removal medium 31 formed for example of a magnetic disk, an optical disk, a magnetooptical disk or a semiconductor memory is attached to the drive 20. A program read by the drive 20 from the removal medium 31 is installed on the storage unit 18, if necessary. Like the storage unit 18, the removal medium 31 can also store data of various types in the storage unit 18.

A hardware structure of the touch detection apparatus 50 according to the present embodiment is described next by referring to FIG. 2.

Figure 2:
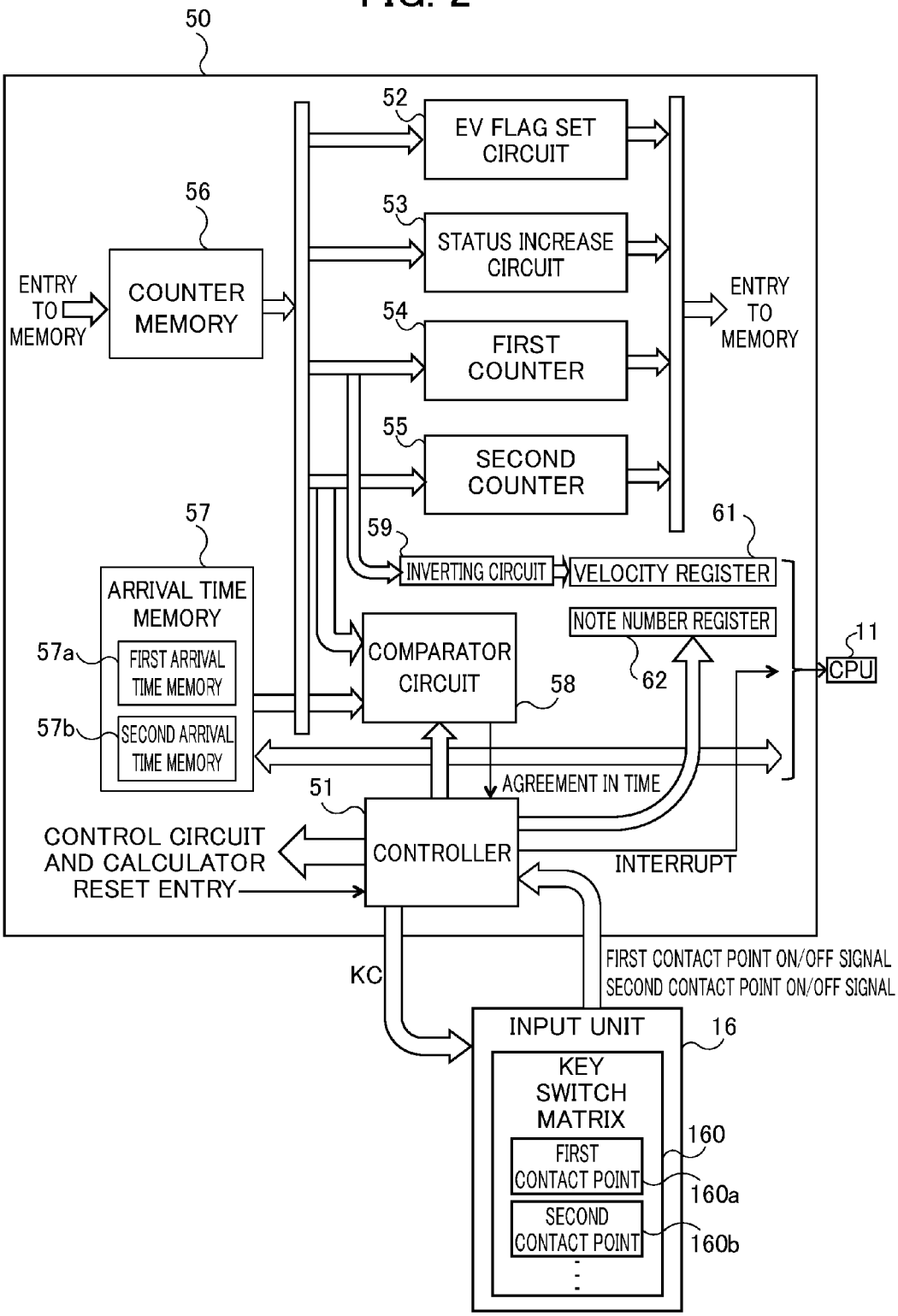
FIG. 2 is a block diagram showing a hardware structure of the touch detection apparatus according to the embodiment of the present invention.

FIG. 2 is a block diagram showing the hardware structure of the touch detection apparatus 50 according to an embodiment of the present invention.

The touch detection apparatus 50 includes a controller 51 functioning as a control circuit, an event flag set circuit 52 (hereinafter also called an "EV flag set circuit 52"), a status increase circuit 53, a first counter 54, a second counter 55, a counter memory 56, an arrival time memory 57, a comparator circuit 58, an inverting circuit 59, a velocity register 61, and a note number register 62.

The controller 51 is connected to the first and second contact points 160*a* and 160*b* of the key switch matrix 160. The controller 51 receives the first contact point on signal, the second contact point on signal, the first contact point off signal, and the second contact point off signal.

The controller 51 controls the remaining hardware of the touch detection apparatus 50, generates a note-on event or a note-off event, and transmits the resultant event through the bus 14 to the CPU 11.

The "note-on event" mentioned in the present embodiment includes the note number of a pressed key of the input unit 16 and a velocity value functioning as initial touch information indicative of the strength of the press of the key.

In response to receipt of the note-on event, the CPU 11 works cooperatively with the sound source 41 to execute control to generate a musical sound corresponding to a note number in this event at an intensity responsive to a velocity.

The "note-off event" mentioned in the present embodiment includes at least the note number of a released key of the input unit 16.

The controller 51 transmits the common switch input signal (KC) to the key switch matrix 160 and receives the first contact point on signal, the second contact point on signal, the first contact point off signal, or the second contact point off signal from the key switch matrix 160.

The controller 51 controls the aforementioned circuits and an adder forming the touch detection apparatus 50 in response to an event flag (hereinafter also called "EV") and a status flag (hereinafter also called "ST").

In the present embodiment, the EV can take on a value "0" or "1."

The EV value "0" means a status where no key is pressed or released.

The EV value "1" means a status where any key is pressed or released. Specifically, the EV value "1" means generation of the note-on event or the note-off event.

In the present embodiment, the ST can take on a value "0," "1," "2," "3," "4," "5," "6" or "7." The ST indicates a transition of a status of measuring a keyboard.

The ST value "0" indicates a status waiting for key press.

The ST value "1" indicates a status where key press bias time described later is being counted.

The ST value "2" indicates a status where a key press velocity measured value described later is being counted.

The ST value "3" indicates a status where a counter value for key press correction time described later is being counted.

The ST value "4" indicates a status waiting for key release.

The ST value "5" indicates a status where key release bias time described later is being counted.

The ST value "6" indicates a status where a key release velocity measured value described later is being counted.

The ST value "7" indicates a status where a counter value for key release correction time described later is being counted.

The controller 51 stores the aforementioned EV values and ST values in the counter memory 56 and sees these values if appropriate. Further, the controller 51 controls the EV flag set circuit 52 and the status increase circuit 53 to make these circuits update the EV values and the ST values.

FIG. 3 shows a format of the counter memory 56 according to the present embodiment.

The counter memory 56 has multiple addresses associated with corresponding ones of multiple keys, more specifically 88 addresses (addresses from 0 to 87 shown in a left-hand part of FIG. 3) in the present embodiment associated with corresponding ones of the 88 keys. Each address stores an EV value, an ST value, a velocity counter value, a counter value for key press correction time, and a counter value for key release correction time that are prepared for an associated key. As described in detail later, the velocity counter value (hereinafter also called "VC"), the key press bias time, and the key release bias time are added by the first counter 54 whereas the counter value for key press correction time and the counter value for key release correction time (hereinafter also called "TC") are added by the second counter 55.

Each address includes a note number (not shown in the drawings) associated with a key.

Referring back to FIG. 2, the EV flag set circuit 52 updates the EV value stored in the counter memory 56 under control by the controller 51.

The status increase circuit 53 updates the ST value stored in the counter memory 56 under control by the controller 51.

Under control by the controller 51, the first counter 54 adds a period of time from when the first contact point 160*a* is turned on until when the second contact point 160*b* is turned on to the VC in the counter memory 56. Under control by the controller 51, the first counter 54 resets the VC in the counter memory 56.

The VC in the counter memory 56 indicates the key press bias time if the ST value is "1" and indicates the key press velocity measured value if the ST value is "2." Specifically, the key press velocity measured value is a value indicative of time determined by subtracting predetermined key press bias time from a period of time from when the first contact point 160*a* is turned on until when the second contact point 160*b* is turned on.

The VC in the counter memory 56 indicates the key release bias time if the ST value is "3" and indicates the key release velocity measured value if the ST value is "4." Specifically, the key release velocity measured value is a value indicative of time determined by subtracting predetermined key release bias time from a period of time from when the second contact point 160*b* is turned off until when the first contact point 160*a* is turned off.

Under control by the controller 51, the second counter 55 adds a period of time from when the first counter 54 finishes addition to the TC in the counter memory 56. Under control by the controller 51, the second counter 55 resets the TC in the counter memory 56.

The arrival time memory 57 includes a first arrival time memory 57*a* and a second arrival time memory 57*b*.

In response to the key press velocity measured value of the VC, the first arrival time memory 57*a* stores predetermined key press arrival time indicative of termination time of addition (count) by the second counter 55.

In response to the key release velocity measured value of the VC, the second arrival time memory 57*b* stores predetermined key release arrival time indicative of termination time of addition (count) by the second counter 55.

In response to a period of time counted by the first counter 54 from when the first contact point 160*a* is turned on until when the second contact point 160*b* is turned on, the controller 51 predicts the key press arrival time indicative of key press timing. In response to a period of time counted by the first counter 54 from when the second contact point 160*b* is turned off until when the first contact point 160*a* is turned off, the controller 51 predicts damper-on arrival time described later.

The controller 51 can set the key release arrival time stored in the second arrival time memory 57*b* as fixed time.

The comparator circuit 58 compares the key press arrival time stored in the first arrival time memory 57*a* and the TC.

If the key press arrival time agrees with the TC, the comparator circuit 58 transmits a key press agreement signal to the controller 51.

The comparator circuit 58 compares the key release arrival time stored in the second arrival time memory 57*b* and the TC. If the key release arrival time agrees with the TC, the comparator circuit 58 transmits a key release agreement signal to the controller 51.

The inverting circuit 59 reads the VC (key press velocity measured value or key release velocity measured value) stored in the counter memory 56, calculates a velocity value by inverting process, and sets (stores) the calculated velocity value in the velocity register 61.

The following describes a transition of the status flag (ST) in the hardware forming the touch detection apparatus 50 according to the present embodiment. A mode of the electronic musical instrument 1 of the present embodiment is described first as a precondition.

The present embodiment assumes an electronic piano as an example. Thus, a conventional note-off event corresponds to a damper-on event in the present embodiment. Damper-on is equivalent to stepping on a damper pedal for the purpose of stopping the vibration of a piano string for sound deadening in the manner of the damper function of an acoustic piano. Specifically, the damper-on event corresponds to the note-off event (sound deadening event) to be generated on the arrival of a damper-on described later.

The electronic musical instrument 1 of the present embodiment has multiple modes for defining a relationship between the aforementioned events including at least the following: "mode0 (multi assign mode)," "mode1 (single assign mode," "note off enable," and "note on 2 enable." The controller 51 executes control to make a switch to any of these modes.

"Mode0" is a mode in which multiple note-on's can be generated simultaneously like in a piano, for example. If a mode is "mode0," multiple note-on's can be generated continuously without intervention of a note-off. Further, in response to generation of a note-off event, all generated sounds of the same note can be deadened. Like in an acoustic piano, this enables multiple presses of a key (keying of multiple number of times) until a damper pedal is stepped on.

"Mode1" is a mode in which a note-on and a note-off of the same sound pitch are generated alternately like in an organ. In the mode "mode1", if multiple sound source generators are not assigned to the same sound pitch like in an organ and the like other than an acoustic piano, a note-on and a note-off can always be generated alternately.

"Note off enable" is a mode in which a note-off for information can be generated while a note-on event and a note-off event are not generated alternately. Specifically, a note-on event and a note-off event are not generated alternately in the mode "mode0," whereas the mode "note off enable" enables generation of a note-off. In the mode "note off enable," timings of generating sounds with two types of feet can differ in a harpsichord or timings of generating sounds of different feet can differ in a Hammond organ, for example. This difference in timing changes in response to a velocity, thereby enabling sound deadening complying with timing in the manner of an actual musical instrument. The mode "note on 2 enable" is a mode in which a note-on is generated while a stroke position passes through the second contact point 160*b* before arriving at a lower limit stroke (position in which a key is in a status immediately before being pressed down completely). In the mode "note on 2 enable," timings of generating sounds with two types of feet can differ in a harpsichord or timings of generating sounds of different feet can differ in a Hammond organ, for example.

Under control by the controller 51, a mode is changed among the aforementioned multiple modes by changing a destination of move of a status or based on an event flag as described later.

A transition of the status flag (ST) is described next by referring to FIG. 4. FIG. 4 shows a transition of the status flag (ST) in the hardware forming the touch detection apparatus 50 according to the present embodiment.

In the status "WAITING FOR KEY PRESS" (see the item "STATUS" in FIG. 4), the controller 51 makes the status increase circuit 53 set the ST value to "0" (see the item "ST" in FIG. 4). Then, a player starts pressing a key. At this time, the EV value stored in the counter memory 56 is "0."

When the key is pressed further to turn on the first contact point 160*a*, the key switch matrix 160 transmits the first contact point on signal to the controller 51.

In response to receipt of the first contact point on signal, the controller 51 identifies a key about which the first contact point on signal has been transmitted. Then, the controller 51 executes control to update various values in the address of the identified key in the counter memory 56 (see FIG. 3). Further, the controller 51 sets (stores) the note number of the identified key in the note number register 62.

The item "STATUS ADVANCE CONDITION" of FIG. 4 indicates a condition for advance of a current status flag (ST). The item "OPERATION FOR ADVANCE" of FIG. 4 indicates a next target status flag (ST).

As an example, if a current value of the ST is "0," "STATUS ADVANCE CONDITION" means turning on the first contact point 160*a* and "OPERATION FOR ADVANCE" is "to ST1" meaning advancing the ST value from "0" to "1."

In response to receipt of the first contact point on signal, the controller 51 makes the status increase circuit 53 set the ST value to "1." The controller 51 further makes the first counter 54 reset the VC and then start making a count to add the VC.

This makes a shift from the status "WAITING FOR KEY PRESS" to the status "KEY PRESS BIAS TIME BEING COUNTED." Specifically, the VC in the counter memory 56 in this status indicates the key press bias time.

The item "ADVANCE TO STOPPING OPERATION IN THE CASE OF LOSS OF CONDITION" of FIG. 4 indicates a status flag (ST) to become a target if "STATUS ADVANCE CONDITION" is no longer satisfied (if "STATUS ADVANCE CONDITION" is lost). As an example, if any error caused in the status "KEY PRESS BIAS TIME BEING COUNTED" disables "arrival of the key press bias time," the ST value is changed from "1" to "0." Specifically, a status returns to "WAITING FOR KEY PRESS."

If the VC value in the counter memory 56 agrees with the key press bias time set in advance to a prescribed value, specifically if the VC arrives at the key press bias time, "STATUS ADVANCE CONDITION" in the status "KEY PRESS BIAS TIME BEING COUNTED" is satisfied. Accordingly, the controller 51 makes the status increase circuit 53 set the ST value to "2." The controller 51 further makes the first counter 54 reset the VC and then start making a count to add the VC.

This makes a shift from the status "KEY PRESS BIAS TIME BEING COUNTED" to the status "KEY PRESS VELOCITY MEASURED VALUE BEING COUNTED." Specifically, the VC in this status indicates the key press velocity measured value.

If any error caused in the status "KEY PRESS VELOCITY MEASURED VALUE BEING COUNTED" disables "arrival of the key press velocity measured value," for example, the ST value is changed from "2" to "0." Specifically, a status returns to "WAITING FOR KEY PRESS."

If the key is pressed further to turn on the second contact point 160*b*, the key switch matrix 160 transmits the second contact point on signal to the controller 51.

Receipt of the second contact point on signal means that "STATUS ADVANCE CONDITION" in the status "KEY PRESS VELOCITY MEASURED VALUE BEING COUNTED" is satisfied. Accordingly, the controller 51 makes the status increase circuit 53 set the ST value to "3" and makes the first counter 54 stop counting the VC. The controller 51 further makes the second counter 55 reset the TC and then start making a count to add the TC.

The item "STATUS RESPONSIVE TO ENTRY OF CONDITION" of FIG. 4 indicates a status triggered by entry of a prescribed condition. Accordingly, if a status is "KEY PRESS VELOCITY MEASURED VALUE BEING COUNTED" and a mode is "note on 2 enable," receipt of the second contact point on signal makes the controller 51 complete the key press and generate a note-on event. This makes a shift from the status "KEY PRESS VELOCITY MEASURED VALUE BEING COUNTED" to the status "KEY PRESS CORRECTION TIME BEING COUNTED." Specifically, the TC in this status indicates key press correction time.

If any error caused in the status "KEY PRESS CORRECTION TIME BEING COUNTED" disables "arrival of the key press correction time," for example, the ST value is changed from "3" to "0." Specifically, a status returns to "WAITING FOR KEY PRESS."

During this period of time, the inverting circuit 59 reads the VC (key press velocity measured value) stored in the counter memory 56, calculates a velocity value by inverting process, and sets (stores) the calculated velocity value in the velocity register 61. Then, the controller 51 generates sound generation information including an interrupt signal, the note number set (stored) in the note number register 62, and the velocity value set (stored) in the velocity register 61.

Next, the comparator circuit 58 compares the key press arrival time set in advance to a prescribed value as a target value in the first arrival time memory 57*a* and the TC. If the key press arrival time and the TC agree with each other, specifically if the TC (key press correction time) arrives at the key press arrival time, "STATUS ADVANCE CONDITION" in the status "KEY PRESS CORRECTION TIME BEING COUNTED" is satisfied. Accordingly, the comparator circuit 58 makes the EV flag set circuit 52 set the EV value to "1," makes the status increase circuit 53 set the ST value to "4," and transmits the key press agreement signal to the controller 51. In response to receipt of the key press agreement signal, the controller 51 transmits the sound generation information including the velocity value to the CPU 11 functioning as the sound generation control unit. Accordingly, in response to arrival of the key press arrival time in the status "KEY PRESS CORRECTION TIME BEING COUNTED," the controller 51 completes the key press and generates a note-on event. This makes a shift from the status "KEY PRESS CORRECTION TIME BEING COUNTED" to the status "WAITING FOR KEY RELEASE." Then, the CPU 11 executes sound generation process of generating a sound based on the sound generation information transmitted from the controller 51.

Next, the player starts releasing a key. At this time, the EV value stored in the counter memory 56 is "1."

When the key is released further to turn off the second contact point 160*b*, the key switch matrix 160 transmits the second contact point off signal to the controller 51.

In response to receipt of the second contact point off signal, the controller 51 identifies the key about which the second contact point off signal has been transmitted. Then, the controller 51 executes control to update various values in the address of the identified key in the counter memory 56 (see FIG. 3). Further, the controller 51 sets (stores) the note number of the identified key in the note number register 62.

Receipt of the second contact point off signal means that "STATUS ADVANCE CONDITION" in the status "WAITING FOR KEY RELEASE" is satisfied. Accordingly, the controller 51 makes the EV flag set circuit 52 set the EV value to "5" and makes the status increase circuit 53 set the ST value to "5." The controller 51 further makes the first counter 54 reset the VC and then start making a count to add the VC. This makes a shift from the status "WAITING FOR KEY RELEASE" to the status "KEY RELEASE BIAS TIME BEING COUNTED." Specifically, the VC in the counter memory 56 in this status indicates the key release bias time. If any error caused in the status "KEY RELEASE BIAS TIME BEING COUNTED" disables "arrival of the key release bias time," for example, the ST value is changed from "5" to "4." Specifically, a status returns to "WAITING FOR KEY RELEASE."

If the VC value in the counter memory 56 agrees with the key release bias time set in advance to a prescribed value, specifically if the VC value arrives at the key release bias time, "STATUS ADVANCE CONDITION" in the status "KEY RELEASE BIAS TIME BEING COUNTED" is satisfied. Accordingly, the controller 51 makes the status increase circuit 53 set the ST value to "6." The controller 51 further makes the first counter 54 reset the VC and then start making a count to add the VC. Specifically, if a status is "KEY RELEASE BIAS TIME BEING COUNTED" and a mode is "note off enable," arrival of the key release bias time makes the controller 51 complete the key release and generate a note-off event. This makes a shift from the status "KEY RELEASE BIAS TIME BEING COUNTED" to the status "KEY RELEASE VELOCITY MEASURED VALUE BEING COUNTED." Specifically, the VC in this status indicates the key release velocity measured value.

If any error caused in the status "KEY RELEASE VELOCITY MEASURED VALUE BEING COUNTED" disables "arrival of the key release velocity measured value" while a mode is "mode0," for example, the ST value is changed from "6" to "1." Specifically, a status returns to "KEY PRESS BIAS TIME BEING COUNTED," so that a note-on measuring status appears again. If a mode is "mode1," the ST value is changed from "6" to "4." Specifically, making a shift to the note-on measuring status again prevents generation of a note-on. This regards key release as a halt to make a status waiting for key release.

If the key is released further to turn off the first contact point 160*a*, the key switch matrix 160 transmits the first contact point off signal to the controller 51. At this time, if a mode is "note off enable," the controller 51 generates a note-off event.

Receipt of the first contact point off signal means that "STATUS ADVANCE CONDITION" in the status "KEY RELEASE VELOCITY MEASURED VALUE BEING COUNTED" is satisfied. Accordingly, the controller 51 makes the EV flag set circuit 52 set the EV value to "1, makes the status increase circuit 53 set the ST value to "7," and makes the first counter 54 stop counting the VC. The controller 51 further makes the second counter 55 reset the TC and then start making a count to add the TC. This makes a shift from the status "KEY RELEASE VELOCITY MEASURED VALUE BEING COUNTED" to the status "KEY RELEASE CORRECTION TIME BEING COUNTED."

Specifically, the TC in this status indicates key release correction time.

If any error caused in the status "KEY RELEASE CORRECTION TIME BEING COUNTED" disables "arrival of the key release correction time" while a mode is "mode0," for example, the ST value is changed from "7" to "1." Specifically, a status returns to "KEY PRESS BIAS TIME BEING COUNTED," so that the note-on measuring status appears again. If a mode is "mode1," the ST value is changed from "7" to "4." Specifically, making a shift to the note-on measuring status again prevents generation of a note-on. This regards key release as a halt to make a status waiting for key release.

During this period of time, the inverting circuit 59 reads the VC (key release velocity measured value) stored in the counter memory 56, calculates a velocity value by inverting process, and sets (stores) the calculated velocity value in the velocity register 61. Then, the controller 51 generates a note-off event including an interrupt signal, the note number set (stored) in the note number register 62, and the velocity value set (stored) in the velocity register 61.

Next, the comparator circuit 58 compares the key release arrival time set in advance to a prescribed value as a target value in the first arrival time memory 57*a* and the TC. If the key release arrival time and the TC agree with each other, specifically if the TC (key release correction time) arrives at the key release arrival time, "STATUS ADVANCE CONDITION" in the status "KEY RELEASE CORRECTION TIME BEING COUNTED" is satisfied. Accordingly, the comparator circuit 58 makes the EV flag set circuit 52 set the EV value to "1," makes the status increase circuit 53 set the ST value to "0," and transmits the key release agreement signal to the controller 51. In response to receipt of the key release agreement signal, the controller 51 transmits the note-off event including the velocity value to the CPU 11 functioning as a sound deadening control unit.

Specifically, if a status is "KEY RELEASE CORRECTION TIME BEING COUNTED," arrival of the key release arrival time makes the controller 51 complete the key release and generate a damper-on event as a note-off event. This makes a shift from the status "KEY RELEASE CORRECTION TIME BEING COUNTED" to the status "WAITING FOR KEY PRESS." Then, the CPU 11 executes sound deadening process of deadening a sound based on the note-off event transmitted from the controller 51.

Next, the comparator circuit 58 compares the key release arrival time set in advance as a target value in the second arrival time memory 57*b* and the TC. If the key release arrival time and the TC agree with each other, specifically if the TC (key release correction time) arrives at the key release arrival time, the comparator circuit 58 transmits the key release agreement signal to the controller 51. In response to receipt of the key release agreement signal, the controller 51 transmits the note-off event including the velocity value to the CPU 11 functioning as the sound deadening control unit.

Then, the CPU 11 executes sound deadening process of deadening a sound based on the note-off event transmitted from the controller 51.

A series of the aforementioned processes performed by the touch detection apparatus 50 is hereinafter called "touch detecting operation process."

The touch detecting operation process performed by the touch detection apparatus 50 determines timings in a period of time from when a sound is generated in response to key press until when the sound is deadened in response to key release. These timings are described below by referring to FIG. 5 to FIG. 10.

Figure 5:
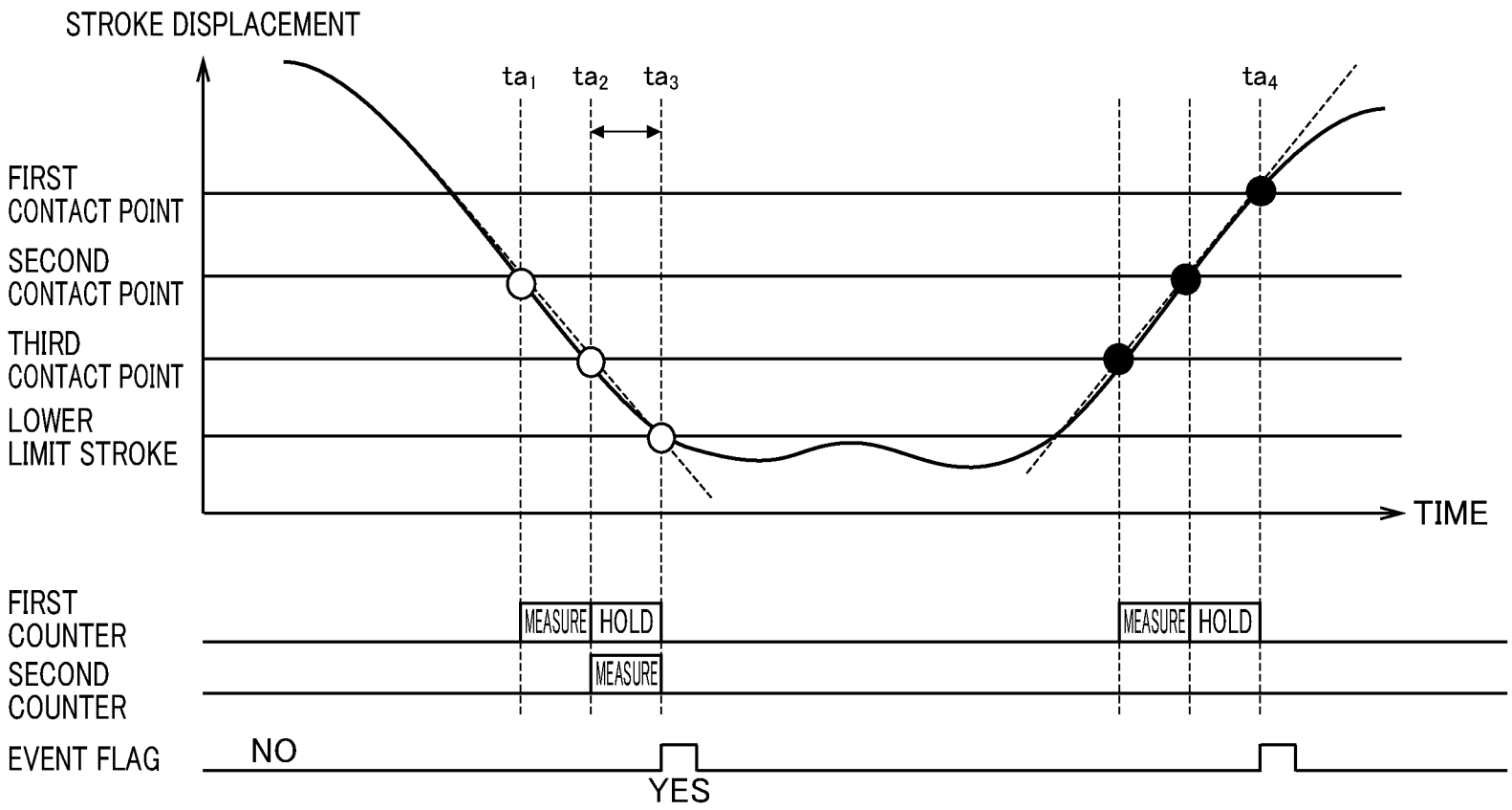
FIG. 5 shows how touch detecting operation process by a conventional three-contact-point touch detection apparatus determines timings in a period of time from when a sound is generated in response to key press until when the sound is deadened in response to key release in comparison to the touch detection apparatus according to an embodiment of the present invention.

More specifically, to facilitate understanding of the present embodiment, described first by referring to FIG. 5 is how the touch detecting operation process by a conventional three-contact-point touch detection apparatus (not shown in the drawings) determines timings in a period of time from when a sound is generated in response to key press until when the sound is deadened in response to key release.

Described next is how the touch detecting operation process by a touch detection apparatus (not shown in the drawings) invented by the present inventors as a basis of the present embodiment determines timings in a period of time from when a sound is generated in response to key press until when the sound is deadened in response to key release.

Described next by referring to FIG. 7 to FIG. 10 is how the touch detecting operation process by the touch detection apparatus 50 of the present embodiment determines timings in a period of time from when a sound is generated in response to key press until when the sound is deadened in response to key release.

FIG. 5 shows timings determined in a period of time from when a sound is generated in response to key press until when the sound is deadened in response to key release using a conventional touch detection apparatus (not shown in the drawings) provided in an electronic piano to detect velocity information with three contact points in different stroke positions.

For the convenience of description, these three contact points are called a first contact point, a second contact point, and a third contact point in the order of increasing depth of a stroke position.

At the time of key press, the conventional touch detection apparatus of FIG. 5 measures a difference ($t_{a2}-t_{a1}$) between times when two contact points including the second and third contact points are turned on. Based on the time difference ($t_{a2}-t_{a1}$), the conventional touch detection apparatus of FIG.

5 predicts time (key press arrival time) $t_{a3}$ of arrival of a lower limit stroke position and generates a note-on event at the predicted time $t_{a3}$.

At the time of key release, the conventional touch detection apparatus of FIG. 5 generates a note-off (equivalent to the damper-on of the present embodiment) event at time $t_{a4}$ when the first contact point is turned off.

In this way, the conventional touch detection apparatus of FIG. 5 detects velocity information with the three contact points. Accordingly, contact points should be increased from two to three for one key. This involves many additional parts such as contact points, interconnections, and diodes for a contact point matrix.

Thus, the present inventors have invented the touch detection apparatus using only two contact points to achieve performance relating to repetition. For the convenience of description, these two contact points are called a first contact point and a second contact point in the order of increasing depth of a stroke position.

First, the present inventors have invented a touch detection apparatus (not shown in the drawings) as a basis for the touch detection apparatus 50 of the present embodiment.

Figure 6:
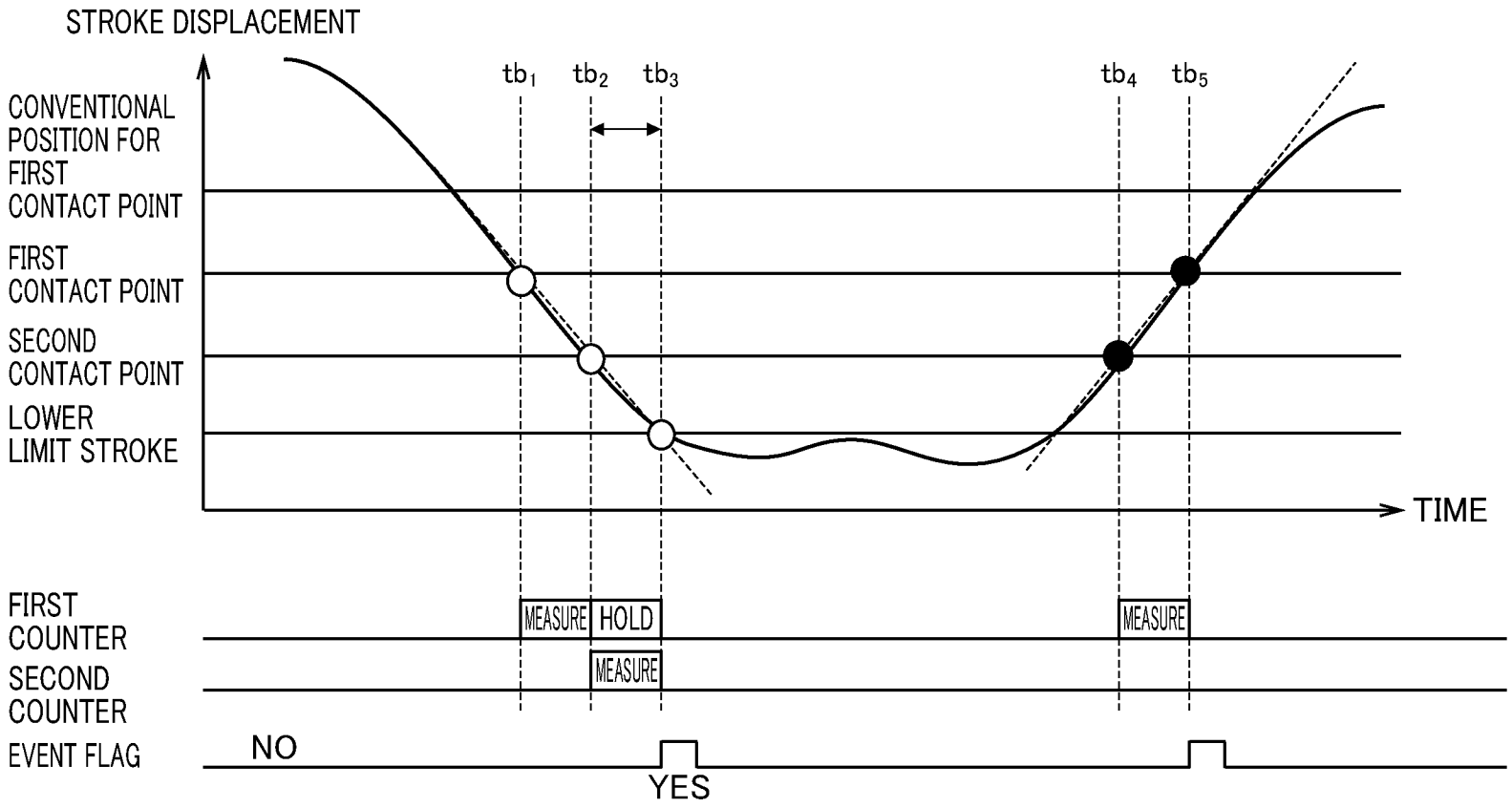
FIG. 6 shows how the touch detecting operation process by a two-contact-point touch detection apparatus determines timings in a period of time from when a sound is generated in response to key press until when the sound is deadened in response to key release in comparison to the touch detection apparatus according to an embodiment of the present invention.

As shown in FIG. 6, this touch detection apparatus places the first contact point in a stroke position deeper than a corresponding stroke position of a conventional two-contact-point system.

FIG. 6 shows timings determined in a period of time from when a sound is generated in response to key press until when the sound is deadened in response to key release using the touch detection apparatus (not shown in the drawings) invented by the present inventor to detect velocity information with two contact points in different stroke positions. As shown in FIG. 6, at the time of key press, the touch detection apparatus of FIG. 6 measures a difference ($t_{b2}-t_{b1}$) between times when the first and second contact points are turned on in this order. Based on the time difference ($t_{b2}-t_{b1}$), the touch detection apparatus of FIG. 6 predicts time (key press arrival time) $t_{b3}$ of arrival of a lower limit stroke position and generates a note-on event at the predicted time $t_{b3}$.

If a mode is "note off enable," for example, the touch detection apparatus of FIG. 6 measures an off velocity value based on a difference ($t_{b5}-t_{b4}$) between times when the second and first contact points are turned off in this order at the time of key release. The touch detection apparatus of FIG. 6 further generates a note-off event.

In the case such as one shown in FIG. 6, the note-off event is generated in a deeper stroke position. This unfortunately causes key release too early or in an unexpectedly shallow position.

Thus, the present inventors have invented the touch detection apparatus 50 of the present embodiment with the intention of avoiding such unfortunate situations. The touch detection apparatus 50 of the present embodiment makes each hardware of the touch detection apparatus 50 operate to comply with the timings shown in FIG. 4, so that a sound is generated or deadened to comply with the timings such as those shown in FIGS. 7 to 10.

FIG. 7 to FIG. 10 each show timings determined in a period of time from when a sound is generated in response to key press until when the sound is deadened in response to key release using the touch detection apparatus 50 according to the present embodiment. The touch detection apparatus 50 according to the present embodiment uses two contact points and places the first contact point in the same position as a conventional position. The touch detection apparatus 50 of the present embodiment is intended to generate an event in a manner similar to that of the embodiment of FIG. 5 using the three contact points.

In the present embodiment shown in FIG. 7 to FIG. 10, turning on the first contact point 160*a* in response to press of a key adds the key press bias time and then adds the key press velocity measured value. If the key is pressed further to turn on the second contact point 160*b*, the key press correction time responsive to the key press velocity measured value is added. After passage of the key press correction time, the sound generation control unit executes sound generation process. This generates a sound to comply with timing of complete pressing down of the key. If the second contact point 160*b* is turned off in response to release of the key, the key release bias time is added and then the key release velocity measured value is added. If the key is released further to turn off the first contact point 160*a*, the key release correction time responsive to the key release velocity measured value is added. After passage of the key release correction time, the sound deadening control unit executes sound deadening process.

Like in the method of estimating the key press arrival time (time of arrival of a lower limit stroke position) based on the key press velocity value given in a note-on, in the example of FIG. 7, the touch detection apparatus 50 predicts (estimates) time of arrival of a damper-on (hereinafter called "damper-on arrival time") based on the key release velocity value given in a note-off.

More specifically, at the time of key release, the touch detection apparatus 50 estimates (measures) damper-on arrival time $t_{c3}$ based on a difference ($t_{c1}-t_{c2}$) between times when the second and first contact points 160*b* and 160*a* are turned off in this order. After passage of the damper-on time $t_{c3}$, the touch detection apparatus 50 can execute control to generate a damper-on event, specifically a note-off event.

Figure 7:
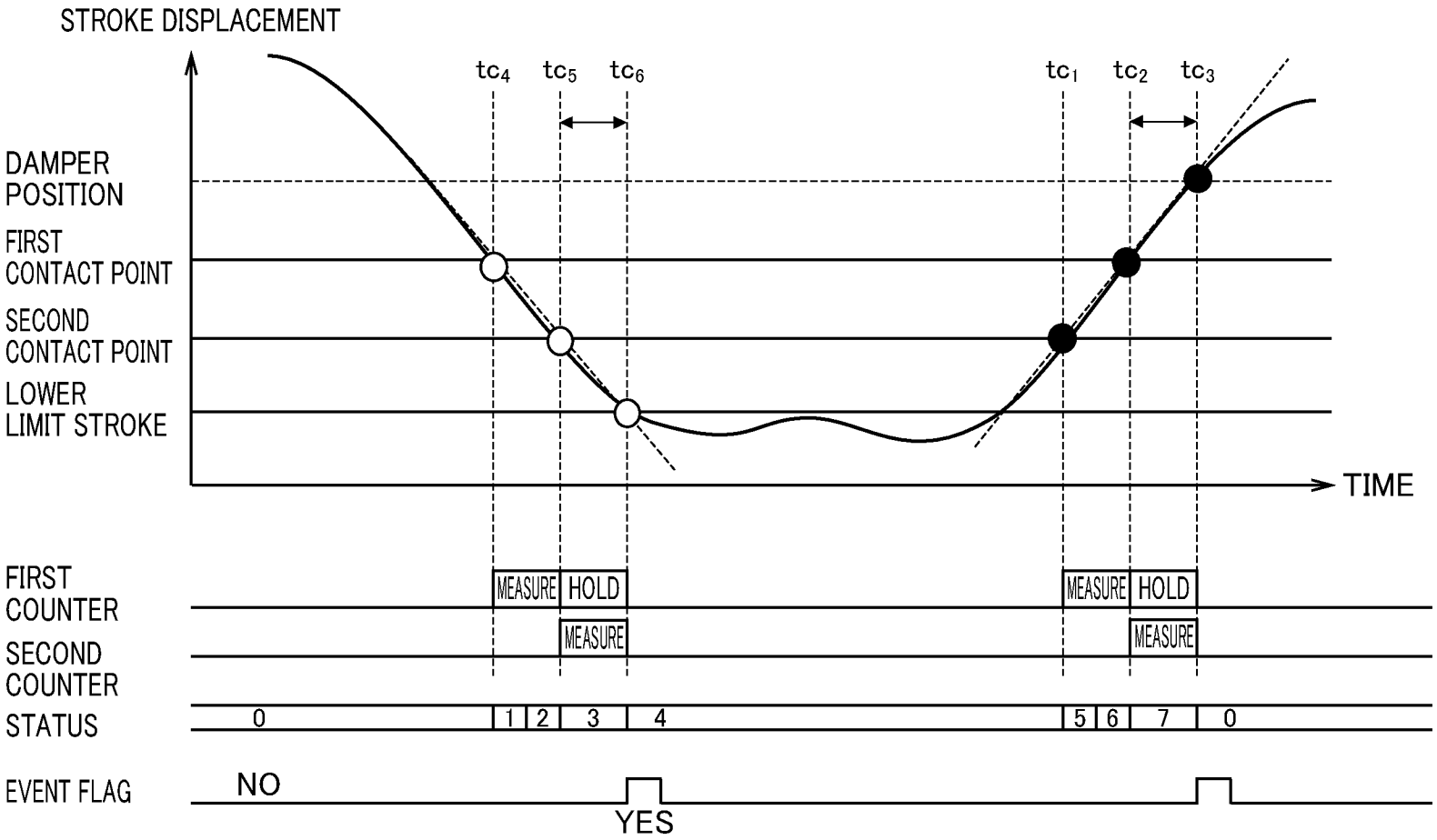
FIG. 7 shows how the touch detecting operation process by the touch detection apparatus according to an embodiment of the present invention determines timings in a period of time from when a sound is generated in response to key press until when the sound is deadened in response to key release.

This damper-on arrival time is considered to be the same as time when a stroke arrives at the position of the first contact point in the conventional touch detection apparatus (corresponding to the damper position of FIG. 7).

In this way, the touch detection apparatus 50 achieves performance relating to repetition and overlap of sounds with only two contact points that are comparable to those achieved by an electronic piano to detect velocity information with three contact points.

In the example of FIG. 7, at the time of key press, the touch detection apparatus 50 estimates (measures) time of arrival of a lower limit stroke position (key press arrival time) $t_{c6}$ based on a difference ($t_{c5}-t_{c4}$) between times when the first and second contact points 160*a* and 160*b* are turned on in this order, and generates a note-on event at the predicted (measured) time $t_{c6}$.

Figure 8:
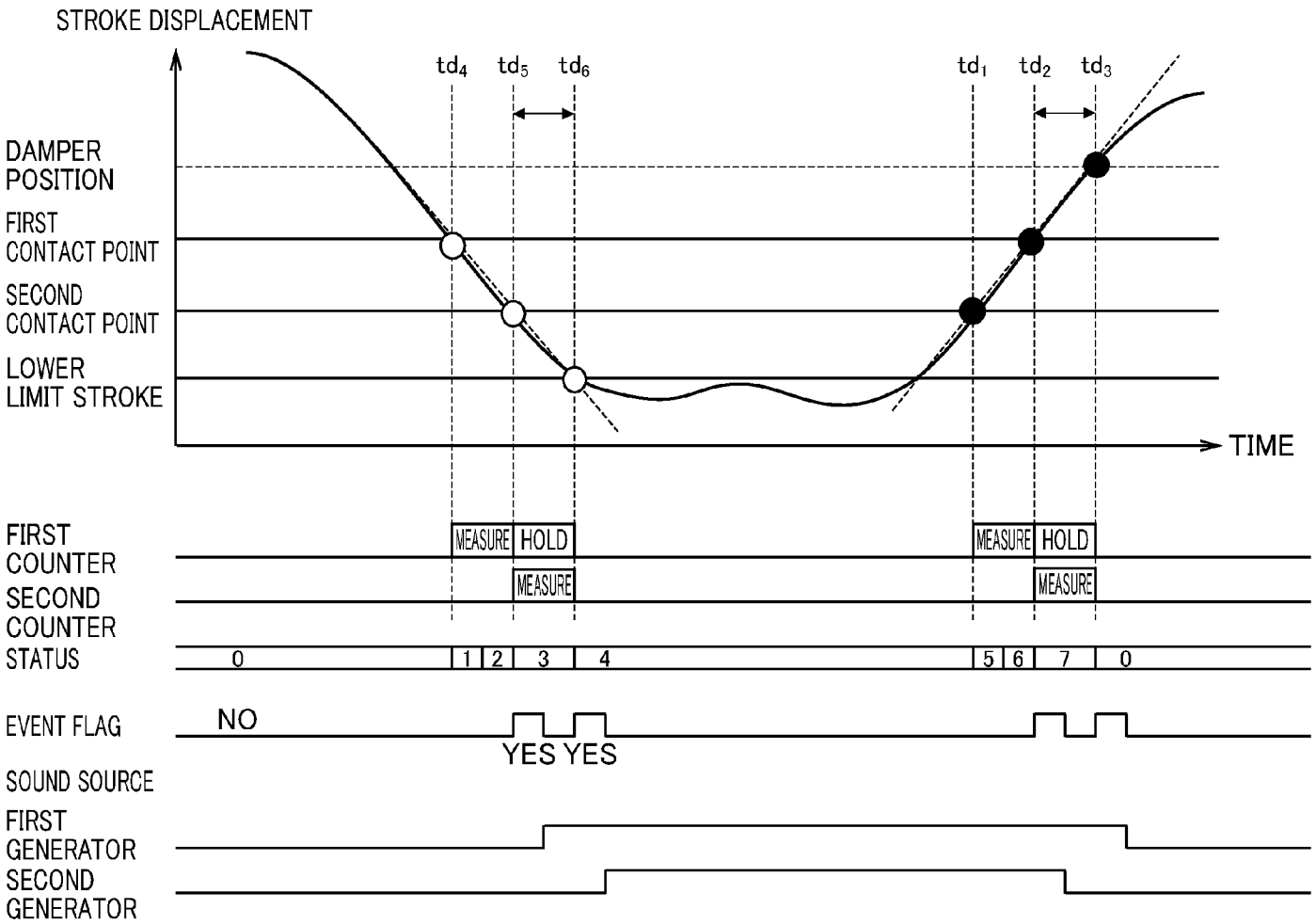
FIG. 8 shows how the touch detecting operation process by the touch detection apparatus according to an embodiment of the present invention determines timings in a period of time from when a sound is generated in response to key press until when the sound is deadened in response to key release.

FIG. 8 shows timings determined in a period of time from when a sound is generated in response to key press until when the sound is deadened in response to key release in the touch detection apparatus 50 of the present embodiment while two modes including "note on 2 enable" and "note off enable" are both asserted.

More specifically, in the example of FIG. 8, at the time of key release, the touch detection apparatus 50 estimates (measures) damper-on time $t_{d3}$ based on a difference ($t_{d2}-t_{d1}$) between times when the second and first contact points 160*b* and 160*a* are turned off in this order. At this time, like in the example of FIG. 7, in the example of FIG. 8, the touch detection apparatus 50 can execute control to generate a note-off event 1 immediately based on the time $t_{d2}$ when the first contact point 160*a* is turned off and then generate a damper-on event, specifically a note-off event 2 after passage of the damper-on time $t_{d3}$.

In the example of FIG. 8, at the time of key press, the touch detection apparatus 50 estimates (measures) time (key press arrival time) $t_{d6}$ indicative of key press timing based on a difference ($t_{d5}-t_{d4}$) between times when the first and second contact points 160*a* and 160*b* are turned on in this order.

At this time, the touch detection apparatus 50 can execute control to generate a note-on event immediately based on the time $t_{d5}$ when the second contact point 160*b* is turned on and then generate a note-on event after passage of the key press arrival time $t_{d6}$.

As a result, using different sound sources (first generator and second generator, for example), the touch detection apparatus 50 according to the present embodiment is allowed to generate sounds with two types of feet in a harpsichord to comply with different timings or generate sounds of different feet in a Hammond organ to comply with different timings, for example. This difference in timing changes in response to a velocity, thereby enabling sound deadening complying with timing in the manner of an actual musical instrument. In this way, sounds of an musical instrument such as a harpsichord or a Hammond organ defining multiple timings of generating sounds can be reproduced.

Figure 9:
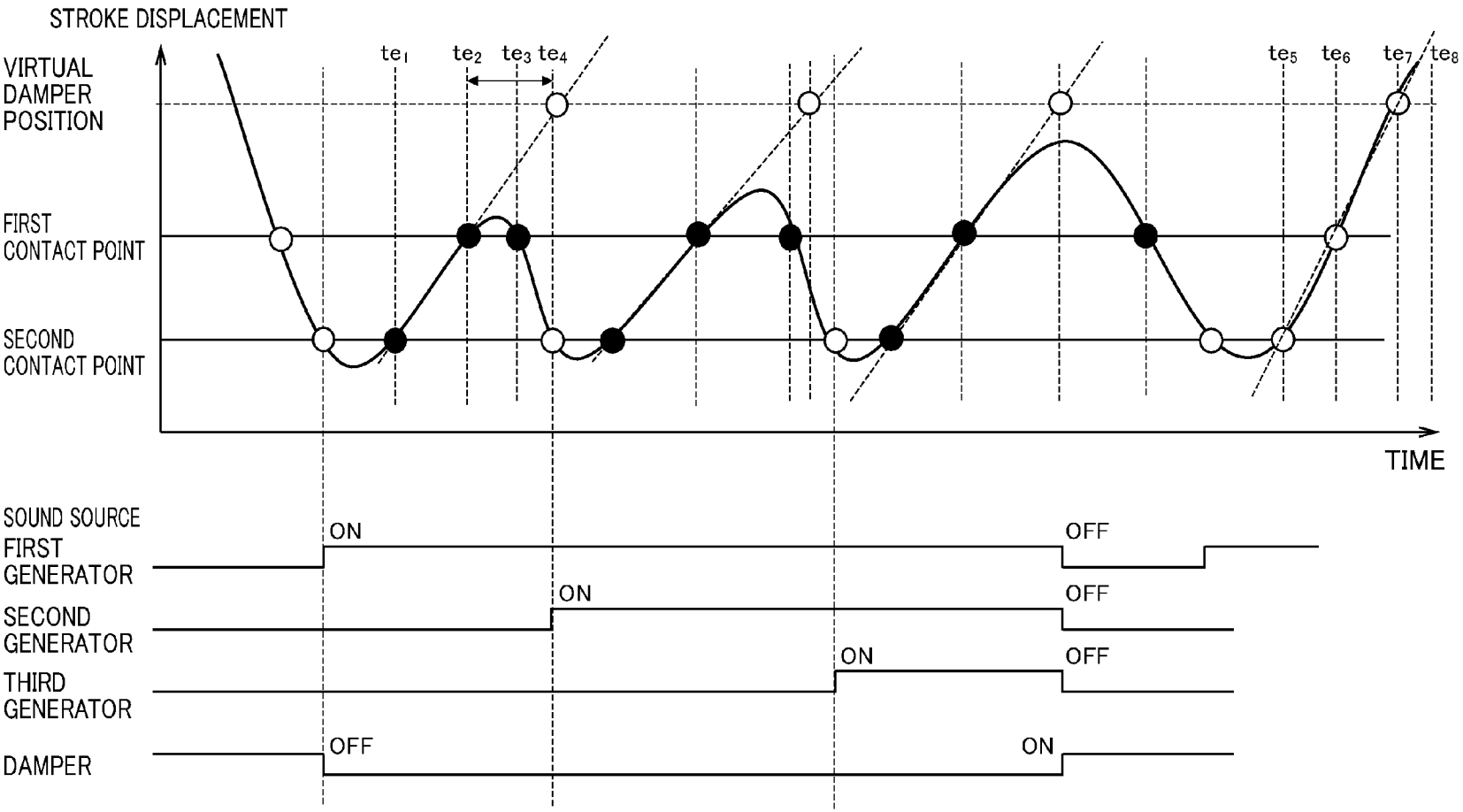
FIG. 9 shows how the touch detecting operation process by the touch detection apparatus according to an embodiment of the present invention determines timings in a period of time from when a sound is generated in response to key press until when the sound is deadened in response to key release.

FIG. 9 shows timings determined in a period of time from when a sound is generated in response to key press until when the sound is deadened in response to key release in the touch detection apparatus 50 of the present embodiment while a mode is "mode0."

The example of FIG. 9 shows a condition of repetition and how sound sources (first generator, second generator, and third generator) to control piano sounds are assigned.

In the example of FIG. 9, the first contact point is placed in a deep stroke position in the touch detection apparatus 50. This allows the touch detection apparatus 50 to be responsive to repetition and a trill of a small stroke amplitude in the deep position.

More specifically, at the time of key release, the touch detection apparatus 50 estimates (measures) damper-on arrival time $t_{e4}$ based on a difference ($t_{e2}-t_{e1}$) between times when the second and first contact points 160*b* and 160*a* are turned off in this order.

If time $t_{e3}$ when the first contact point 160*a* is turned on again is earlier than the damper-on arrival time $t_{e4}$, the touch detection apparatus 50 executes control to generate a note-on event immediately based on the time $t_{e3}$ when the first contact point 160*a* is turned on without generating a damper-on event (note-off event). This can make a different sound source (such as second generator) to generate a different sound.

In this way, in the example of FIG. 9, if repetition is made to turn on the first contact point 160*a* again before the damper-on arrival time $t_{e4}$ comes, specifically if the time $t_{e3}$ when the first contact point 160*a* is turned on again is earlier than the damper-on arrival time $t_{e4}$, the touch detection apparatus 50 can assign multiple sound source generators like in the way of repeating hammering on a string while the damper of the string is released in a piano.

In contrast, if the first contact point 160*a* is not turned on again before damper-on arrival time $t_{e8}$ comes (as shown in the rightmost part of FIG. 9), the touch detection apparatus 50 executes control to generate a damper-on event (note-off event) at the damper-on arrival time $t_{e8}$. As a result, the three generators are turned off.

Figure 10:
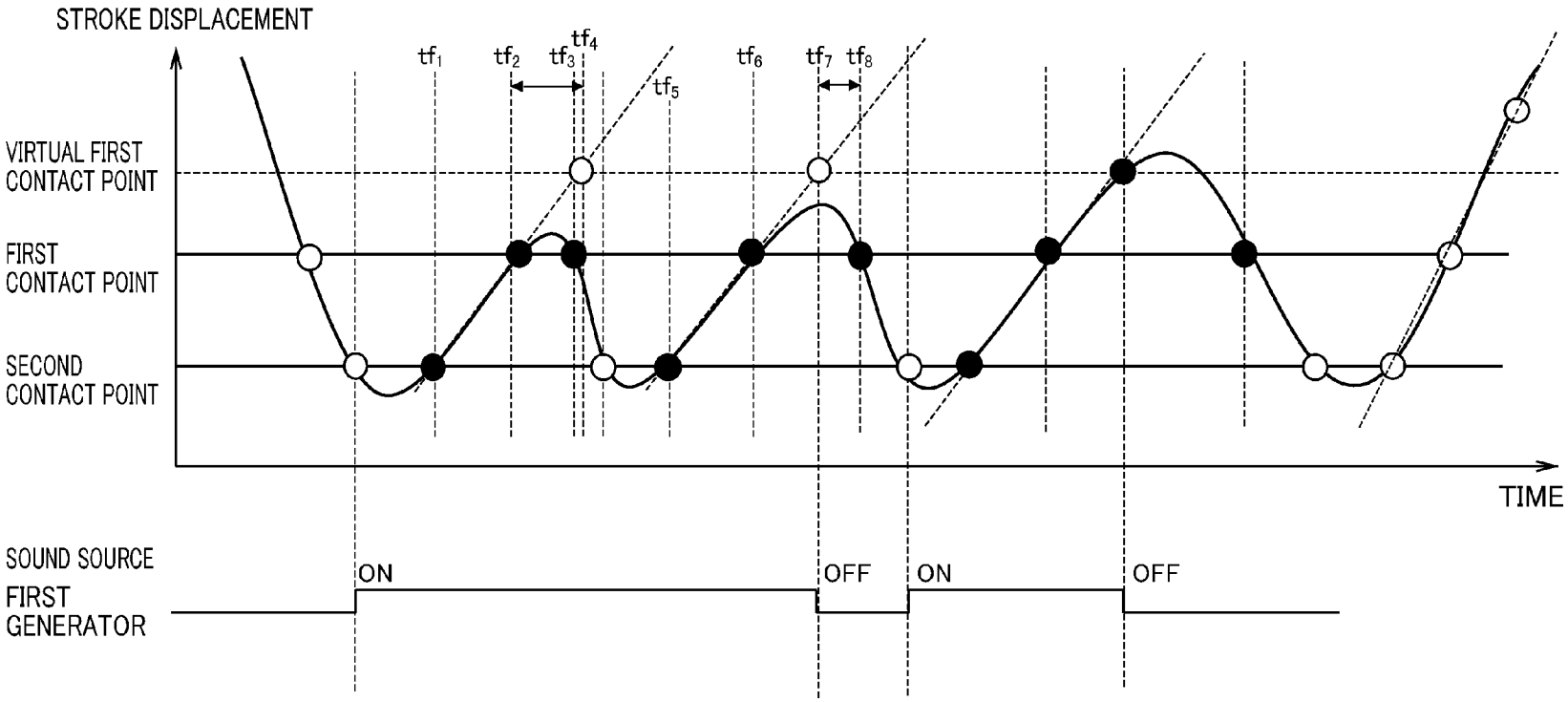
FIG. 10 shows how the touch detecting operation process by the touch detection apparatus according to an embodiment of the present invention determines timings in a period of time from when a sound is generated in response to key press until when the sound is deadened in response to key release.

FIG. 10 shows timings determined in a period of time from when a sound is generated in response to key press until when the sound is deadened in response to key release in the touch detection apparatus 50 of the present embodiment while a mode is "mode1."

FIG. 10 shows an example where the electronic musical instrument 1 is assumed to be a musical instrument other than a piano (where multiple generators are not assigned to a single keyboard).

More specifically, at the time of key release, the touch detection apparatus 50 estimates (measures) time of arrival of a virtual first contact point (hereinafter called "virtual damper-on time") $t_{f4}$ based on a difference ($t_{f2}-t_{f1}$) between times when the second and first contact points 160*b* and 160*a* are turned off in this order.

If time $t_{f3}$ when the first contact point 160*a* is turned on again is earlier than the virtual damper-on time $t_{f4}$, the touch detection apparatus 50 can make a sound source (first generator) generate the same sound continuously.

In contrast, if time $t_{f8}$ when the first contact point 160*a* is turned on again is later than virtual damper-on time $t_{f7}$, the touch detection apparatus 50 executes control to generate a damper-off event (note-off event) at the virtual damper-on time $t_{f7}$.

In this way, the detection apparatus 50 of the present embodiment can prevent adverse effect of giving priority to repetition by making the first contact point deeper that may lead to too early key release or key release in an unexpectedly shallow position.

The following describes the touch detecting operation process by the hardware forming the touch detection apparatus 50 according to the present embodiment by referring to FIG. 11 to FIG. 19.

FIG. 11 to FIG. 19 are flowcharts showing the flow of the touch detecting operation process by the touch detection apparatus 50 according to the present embodiment.

Figure 11:
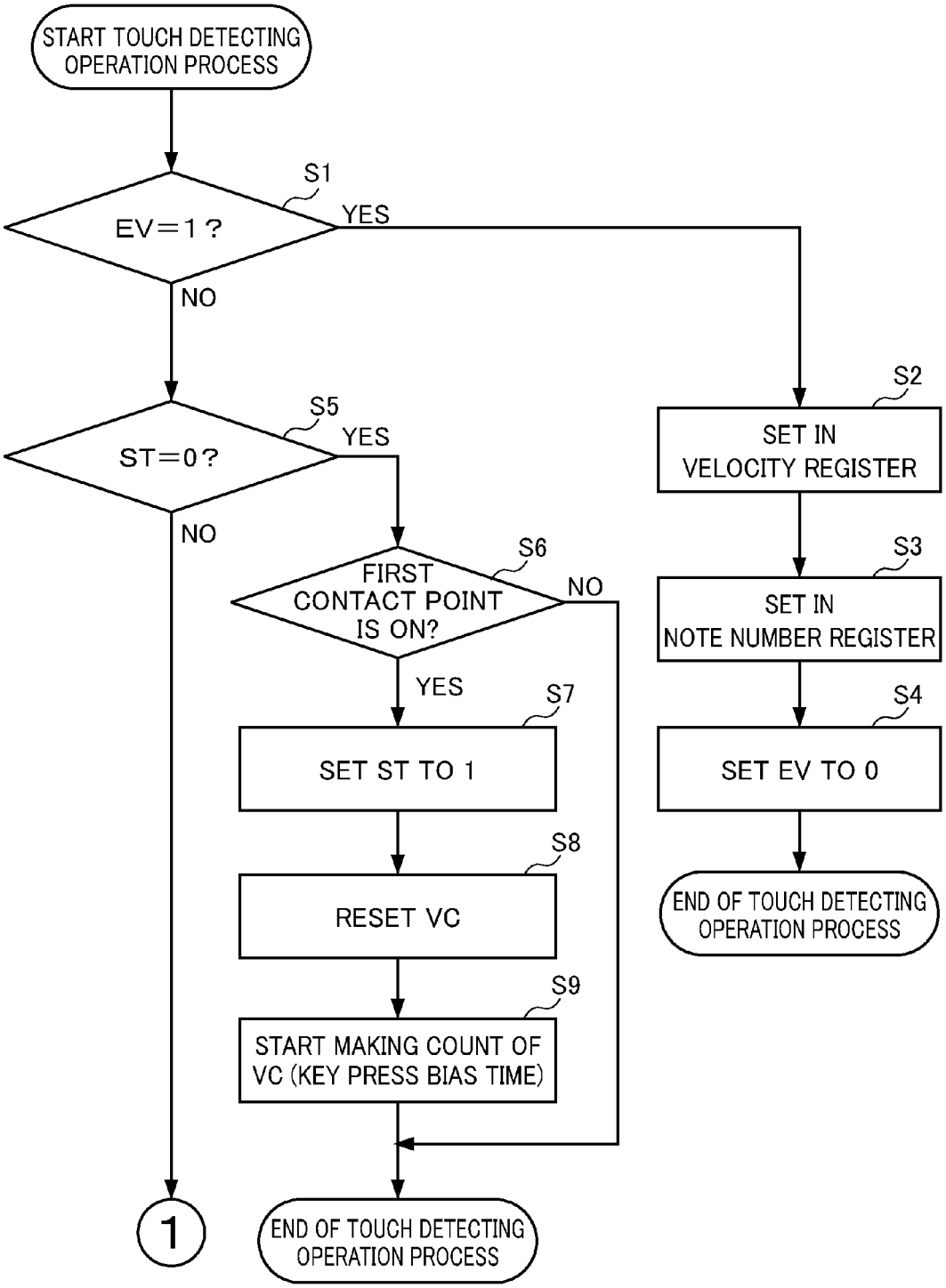
FIG. 11 is a flowchart showing a flow of the touch detecting operation process by the touch detection apparatus of FIG. 2.

As shown in FIG. 11, in Step S1, the controller 51 judges whether the EV value in the counter memory 56 is "1." If the EV value is "1," it is judged as YES in Step S1 and the processing shifts to Step S2. If the EV value is not "1," it is judged as NO in Step S1 and the processing shifts to Step S5. Processes in Step S5 and its following steps will be described later.

In Step S2, the inverting circuit 59 reads the VC (key press velocity measured value) stored in the counter memory 56, calculates a velocity value by inverting process, and sets (stores) the calculated velocity value in the velocity register 61.

In Step S3, the controller 51 sets (stores) the note number of a key in the note number register 62 about which the first contact point on signal or the second contact point on signal has been received.

In Step S4, the EV flag set circuit 52 sets the EV to "0," thereby updating the EV value in the counter memory 56 to "0." Finishing this process means the end of the touch detecting operation process.

In step S5, the controller 51 judges whether the ST value in the counter memory 56 is "0." If the ST value is "0," it is judged as YES in Step S5 and the processing shifts to Step S6. If the ST value is not "0," it is judged as NO in Step S5 and the processing shifts to step S10. Processes in Step S10 and its following steps will be described later.

In Step S6, the controller 51 judges whether the first contact point on signal has been received. If the first contact point on signal has been received, it is judged as YES in Step S6 and the processing shifts to step S7. If the first contact point on signal has not been received, it is judged as NO in Step S6 and the touch detecting operation process is finished.

In step S7, the status increase circuit 53 sets the ST to "1," thereby updating the ST value in the counter memory 56 to "1."

In step S8, the first counter 54 resets the VC in the counter memory 56.

In step S9, the first counter 54 starts making a count of the VC (key press bias time) in the counter memory 56 and adds the count to the VC in the counter memory 56. Finishing this process means the end of the touch detecting operation process.

Figure 12:
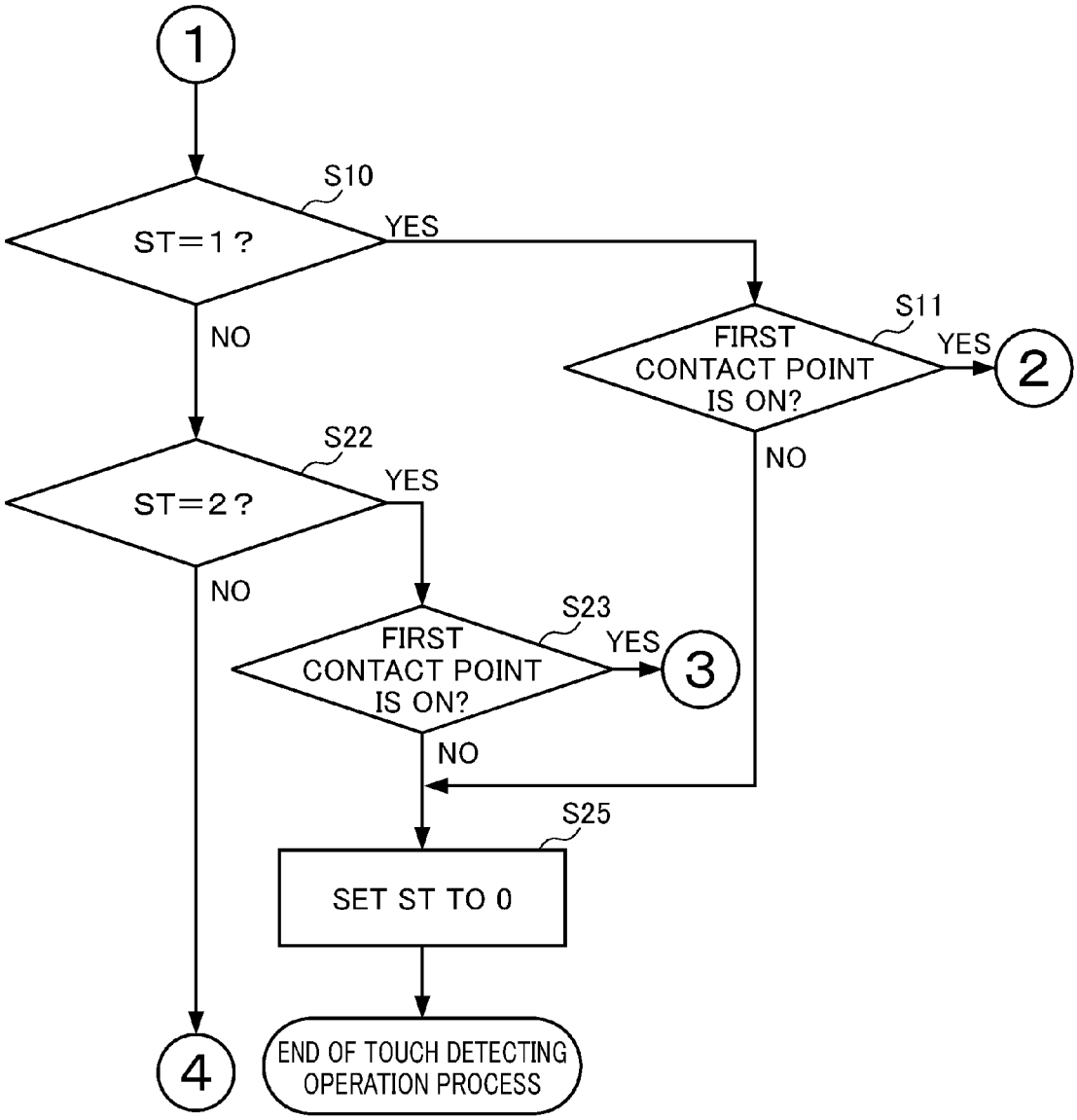
FIG. 12 is a flowchart showing the flow of the touch detecting operation process by the touch detection apparatus of FIG. 2.

As shown in FIG. 12, in step S10, the controller 51 judges whether the ST value in the counter memory 56 is "1." If the ST value is "1," it is judged as YES in Step S10 and the processing shifts to step S11. If the ST value is not "1," it is judged as NO in Step S10 and the processing shifts to step S22. Processes in Step S22 and its following steps will be described later.

In Step S11, the controller 51 judges whether the first contact point on signal has been received. If the first contact point on signal has been received, it is judged as YES in Step S11 and the processing shifts to step S12. If the first contact point on signal has not been received, it is judged as NO in Step S11 and the processing shifts to step S25. Processes in Step S25 and its following steps will be described later.

Figure 13:
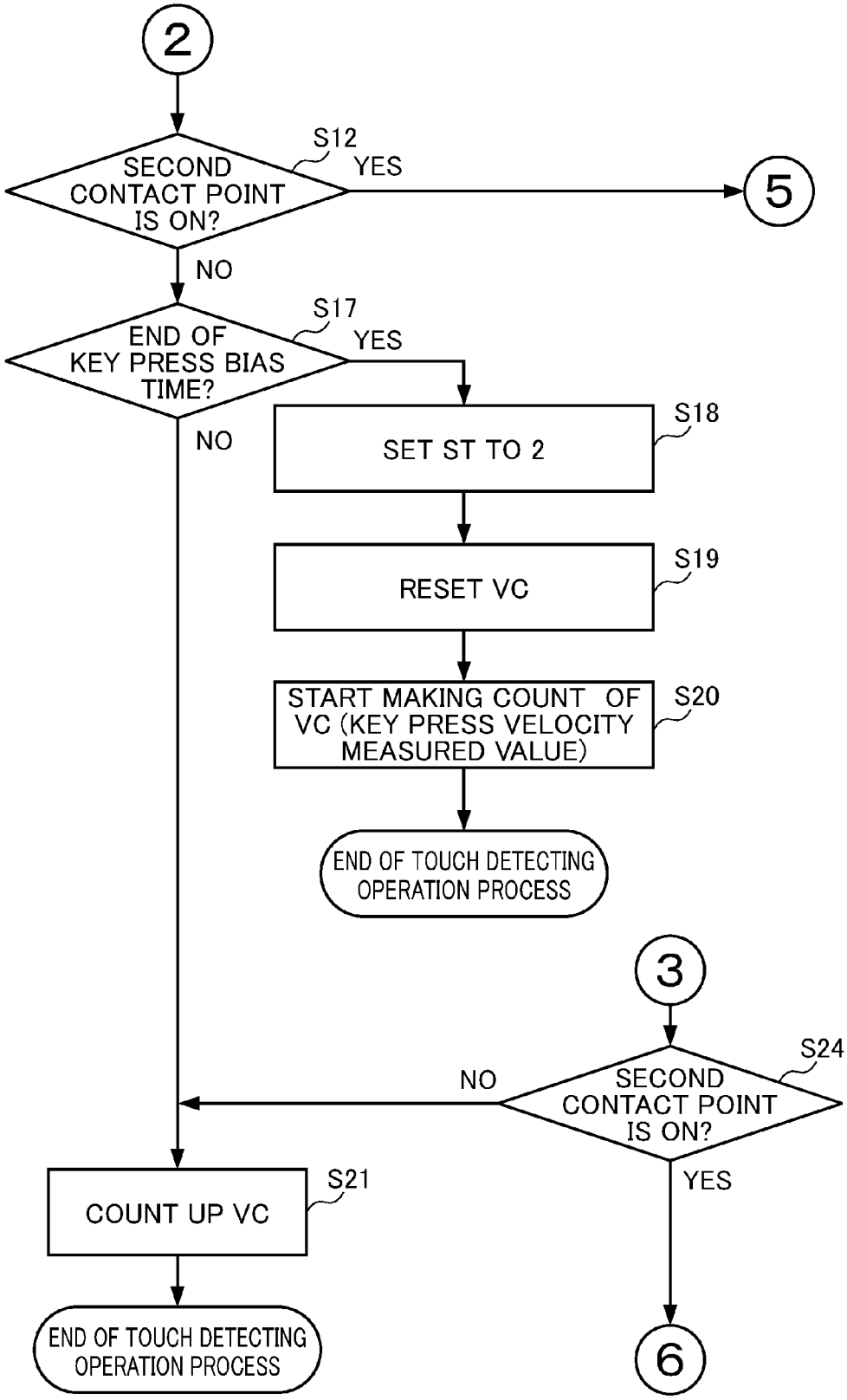
FIG. 13 is a flowchart showing the flow of the touch detecting operation process by the touch detection apparatus of FIG. 2.

As shown in FIG. 13, in Step S12, the controller 51 judges whether the second contact point on signal has been received. If the second contact point on signal has been received, it is judged as YES in Step S12 and the processing shifts to step S13. If the second contact point on signal has not been received, it is judged as NO in Step S12 and the processing shifts to step S17. Processes in Step S17 and its following steps will be described later.

Figure 14:
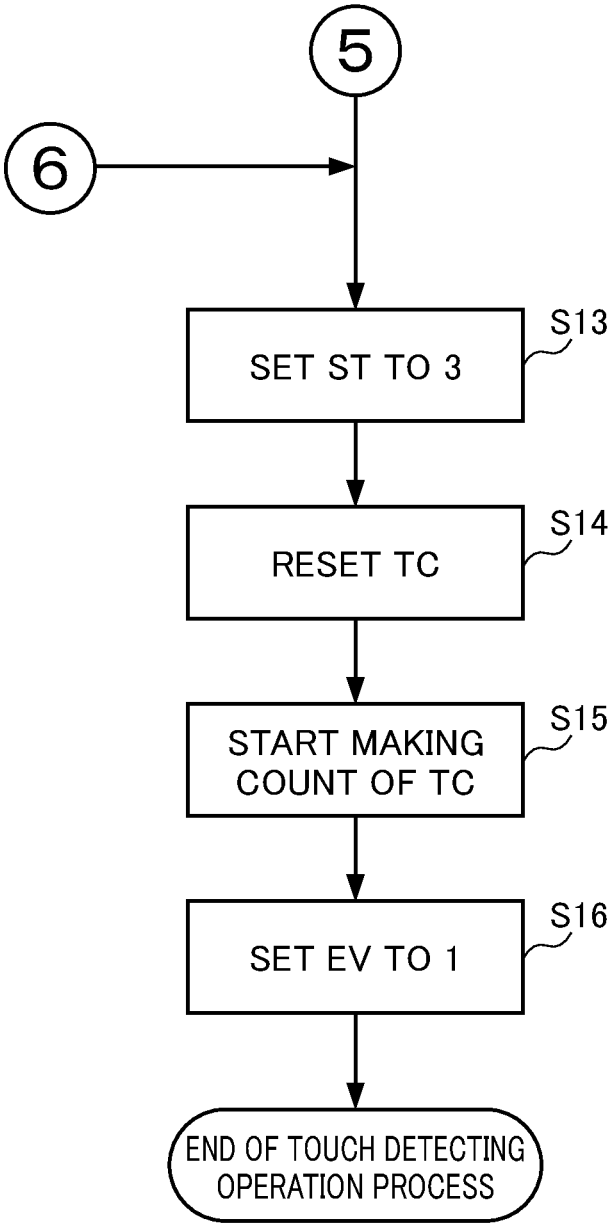
FIG. 14 is a flowchart showing the flow of the touch detecting operation process by the touch detection apparatus of FIG. 2.

As shown in FIG. 14, in Step S13, the status increase circuit 53 sets the ST to "3," thereby updating the ST value in the counter memory 56 to "3."

In step S14, the second counter 55 resets the TC in the counter memory 56.

In step S15, the second counter 55 starts making a count of the TC and adds the count to the TC in the counter memory 56.

In Step S16, if a mode is "note on 2 enable," the EV flag set circuit 52 sets the EV to "1," thereby updating the EV value in the counter memory 56 to "1." Finishing this process means the end of the touch detecting operation process.

Referring back to FIG. 13, in step S17, the controller 51 judges whether the VC in the counter memory 56 agrees with the predetermined key press bias time, specifically judges the arrival of the key press bias time by judging whether the VC agrees with a predetermined value. If the VC agrees with the key press bias time, it is judged as YES in Step S17 and the processing shifts to Step S18. If the VC does not agree with the key press bias time, it is judged as NO in Step S17 and the processing shifts to Step S21. Processes in Step S21 and its following steps will be described later.

In Step S18, the status increase circuit 53 sets the ST to "2," thereby updating the ST value in the counter memory 56 to "2."

In Step S19, the first counter 54 resets the VC in the counter memory 56.

In Step S20, the first counter 54 starts making a count of the VC (key press velocity measured value) in the counter memory 56 and adds the count to the VC in the counter memory 56. Finishing this process means the end of the touch detecting operation process.

In Step S21, the first counter 54 counts up the VC to continue adding the VC in the counter memory 56.

Referring back to FIG. 12, in Step S22, the controller 51 judges whether the ST value in the counter memory 56 is "2." If the ST value is "2," it is judged as YES in Step S22 and the processing shifts to Step S23. If the ST value is not "2," it is judged as NO in Step S22 and the processing shifts to Step S26. Processes in Step S26 and its following steps will be described later.

In Step S23, the controller 51 judges whether the first contact point on signal has been received. If the first contact point on signal has been received, it is judged as YES in Step S23 and the processing shifts to step S24. If the first contact point on signal has not been received, it is judged as NO in Step S23 and the processing shifts to step S25. Processes in Step S25 and its following steps will be described later.

As shown in FIG. 13, in Step S24, the controller 51 judges whether the second contact point on signal has been received. If the second contact point on signal has been received, it is judged as YES in Step S24 and the processing shifts to step S13. If the second contact point on signal has not been received, it is judged as NO in Step S24 and the processing shifts to step S21.

As shown in FIG. 12, in Step S25, the status increase circuit 53 sets the ST to "0," thereby updating the ST value in the counter memory 56 to "0." Finishing this process means the end of the touch detecting operation process.

Figure 15:
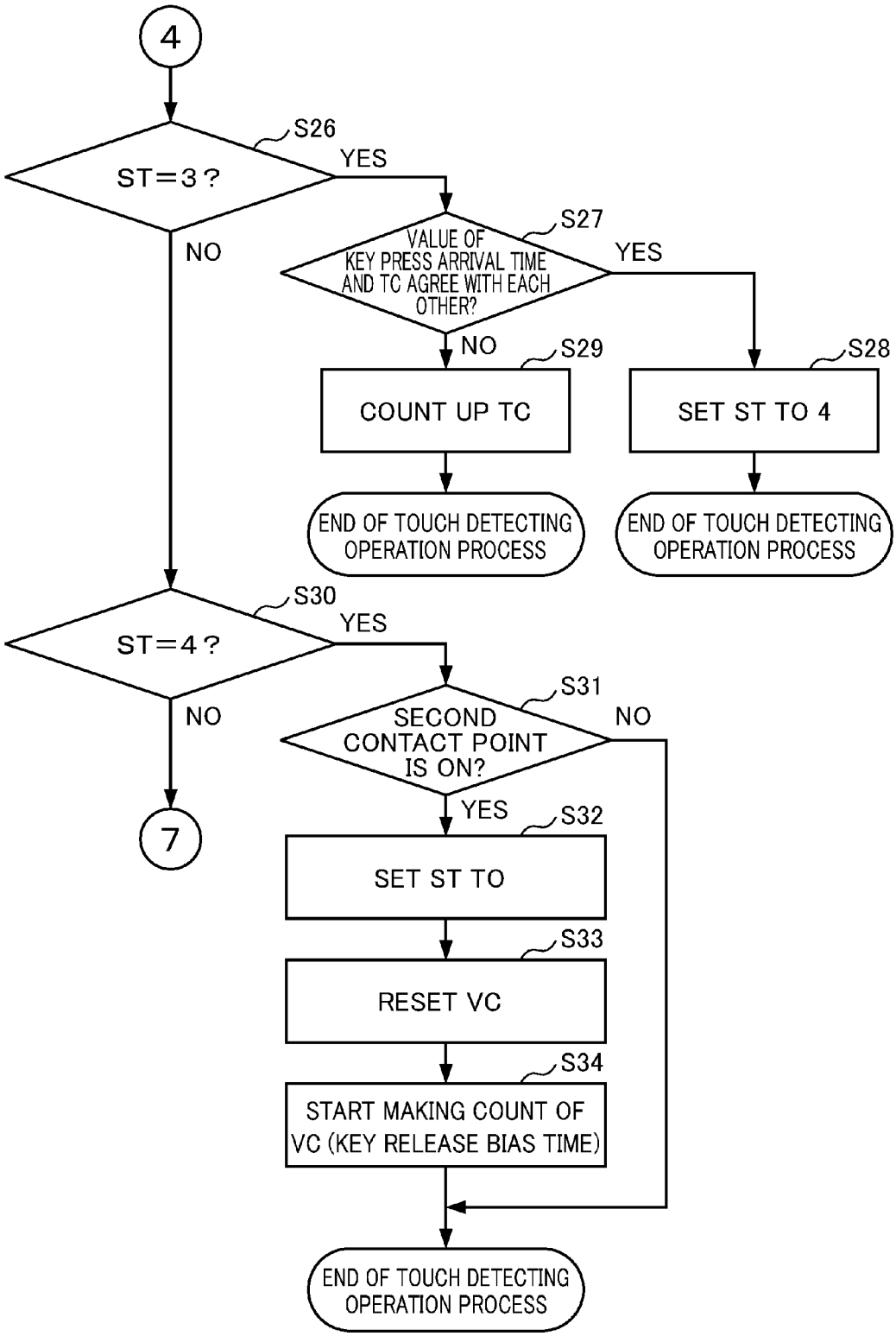
FIG. 15 is a flowchart showing the flow of the touch detecting operation process by the touch detection apparatus of FIG. 2.

As shown in FIG. 15, in Step S26, the controller 51 judges whether the ST value in the counter memory 56 is "3." If the ST value is "3," it is judged as YES in Step S26 and the processing shifts to Step S27. If the ST value is not "3," it is judged as NO in Step S26 and the processing shifts to Step S30. Processes in Step S30 and its following steps will be described later.

In Step S27, the comparator circuit 58 compares the key press arrival time stored in the first arrival time memory 57*a* and the TC in the counter memory 56 to judge whether the key press arrival time and the TC agree with each other. If the key press arrival time and the TC are judged as agreeing with each other, it is judged as YES in Step S27 and the processing shifts to Step S28. If the key press arrival time and the TC are judged as not agreeing with each other, it is judged as NO in Step S27 and the processing shifts to Step S29. Processes in Step S29 and its following steps will be described later.

In Step S28, the status increase circuit 53 sets the ST to "4," thereby updating the ST value in the counter memory 56 to "4." Finishing this process means the end of the touch detecting operation process.

In Step S29, the second counter 55 counts up the TC to continue adding the TC in the counter memory 56. Finishing this process means the end of the touch detecting operation process.

In Step S30, the controller 51 judges whether the ST value in the counter memory 56 is "4." If the ST value is "4," it is judged as YES in Step S30 and the processing shifts to Step S31. If the ST value is not "4," it is judged as NO in Step S30 and the processing shifts to Step S35. Processes in Step S35 and its following steps will be described later.

In Step S31, the controller 51 judges whether the second contact point on signal has been received. If the second contact point on signal has been received, it is judged as YES in Step S31 and the processing shifts to step S32. If the second contact point on signal has not been received, it is judged as NO in Step S31 and the touch detecting operation process is finished.

In Step S32, the status increase circuit 53 sets the ST to "5," thereby updating the ST value in the counter memory 56 to "5."

In Step S33, the first counter 54 resets the VC in the counter memory 56.

In Step S34, the first counter 54 starts making a count of the VC (key release bias time) in the counter memory 56 and adds the count to the VC in the counter memory 56. Finishing this process means the end of the touch detecting operation process.

Figure 16:
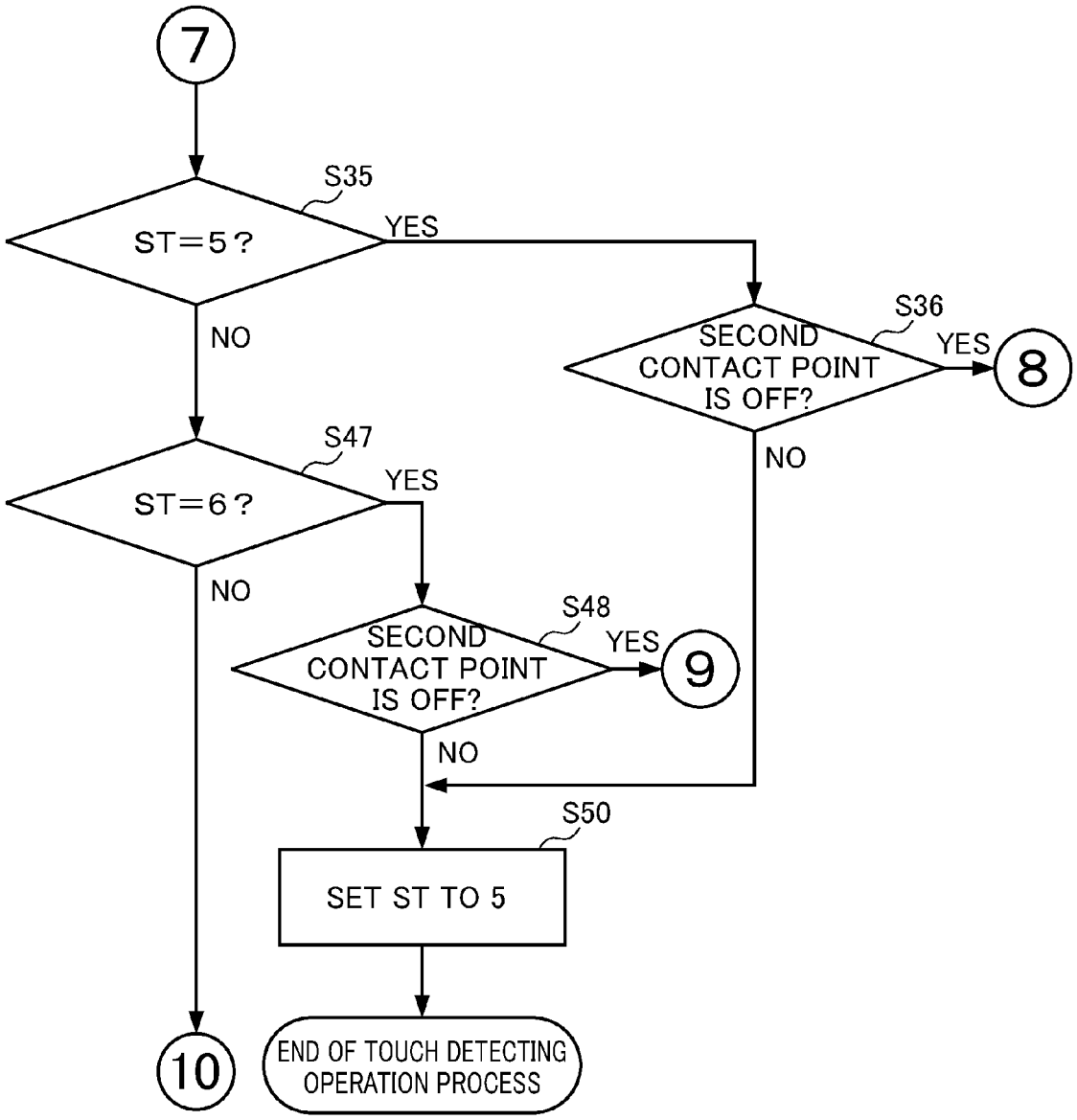
FIG. 16 is a flowchart showing the flow of the touch detecting operation process by the touch detection apparatus of FIG. 2.

As shown in FIG. 16, in Step S35, the controller 51 judges whether the ST value in the counter memory 56 is "5." If the ST value is "5," it is judged as YES in Step S35 and the processing shifts to Step S36. If the ST value is not "5," it is judged as NO in Step S35 and the processing shifts to Step S47. Processes in Step S47 and its following steps will be described later.

In Step S36, the controller 51 judges whether the second contact point off signal has been received. If the second contact point off signal has been received, it is judged as YES in Step S36 and the processing shifts to step S37. If the second contact point off signal has not been received, it is judged as NO in Step S36 and the processing shifts to step S50. Processes in Step S50 and its following steps will be described later.

Figure 17:
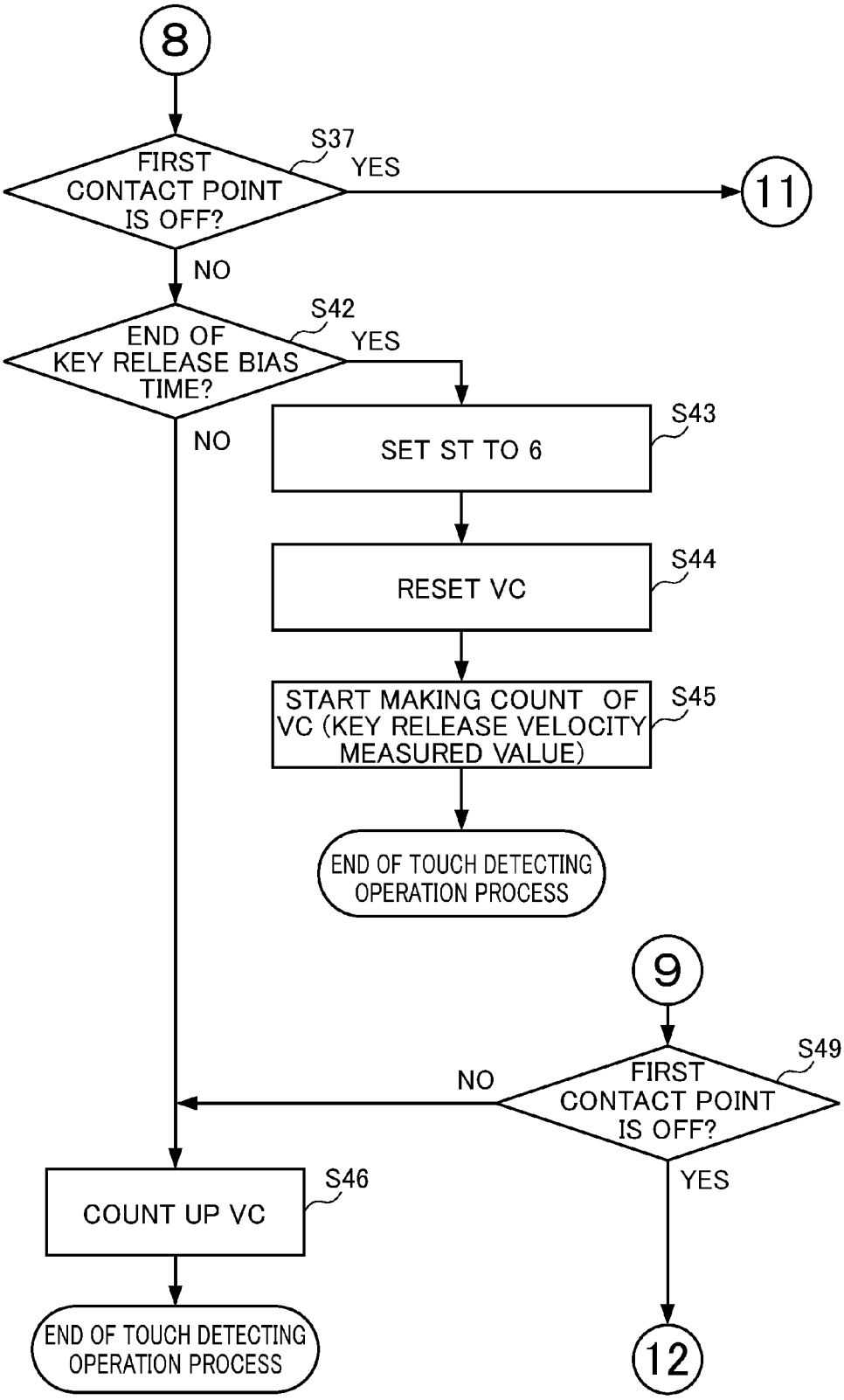
FIG. 17 is a flowchart showing the flow of the touch detecting operation process by the touch detection apparatus of FIG. 2.

As shown in FIG. 17, in Step S37, the controller 51 judges whether the first contact point off signal has been received. If the first contact point off signal has been received, it is judged as YES in Step S37 and the processing shifts to Step S38. If the first contact point off signal has not been received, it is judged as NO in Step S37 and the processing shifts to Step S42. Processes in Step S42 and its following steps will be described later.

Figure 18:
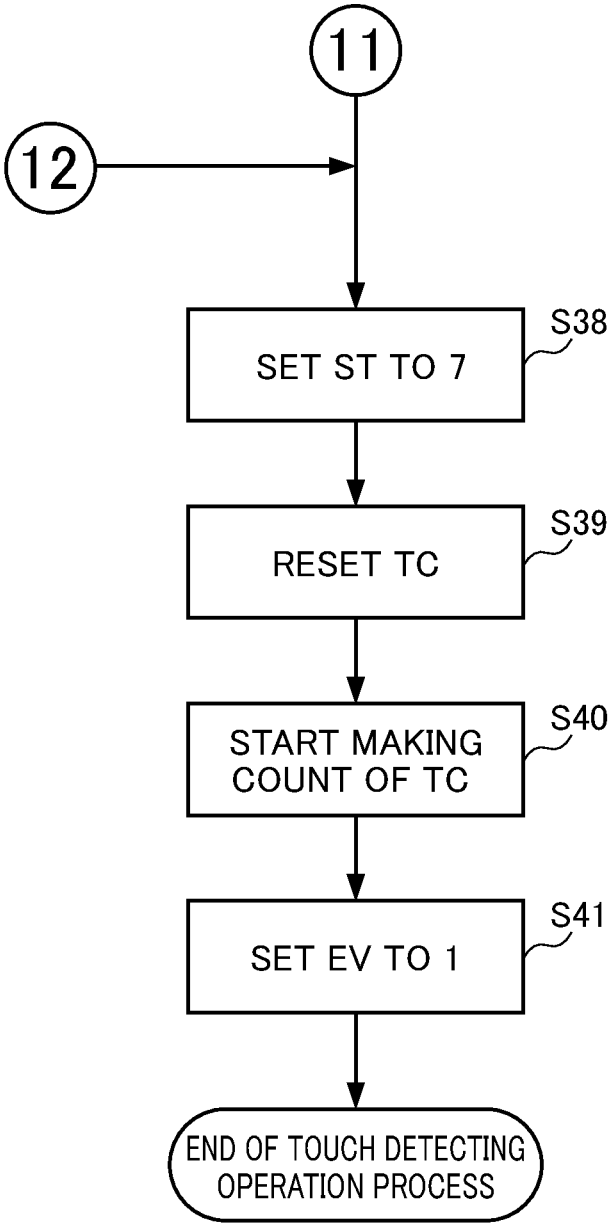
FIG. 18 is a flowchart showing the flow of the touch detecting operation process by the touch detection apparatus of FIG. 2.

As shown in FIG. 18, the status increase circuit 53 sets the ST to "7," thereby updating the ST value in the counter memory 56 to "7."

In step S39, the second counter 55 resets the TC in the counter memory 56.

In step S40, the second counter 55 starts making a count of the TC and adds the count to the TC in the counter memory 56.

In Step S41, if a mode is "note off enable," the EV flag set circuit 52 sets the EV to "1," thereby updating the EV value in the counter memory 56 to "1." Finishing this process means the end of the touch detecting operation process.

Referring back to FIG. 17, in step S42, the controller 51 judges whether the VC in the counter memory 56 agrees with the predetermined key release bias time, specifically judges the arrival of the key release bias time by judging whether the VC agrees with a predetermined value. If the VC agrees with the key release bias time, it is judged as YES in Step S42 and the processing shifts to Step S43. If the VC does not agree with the key release bias time, it is judged as NO in Step S42 and the processing shifts to Step S46. Processes in Step S46 and its following steps will be described later.

In Step S43, the status increase circuit 53 sets the ST to "6," thereby updating the ST value in the counter memory 56 to "6."

In Step S44, the first counter 54 resets the VC in the counter memory 56.

In Step S45, the first counter 54 starts making a count of the VC (key release velocity measured value) in the counter memory 56 and adds the count to the VC in the counter memory 56. Finishing this process means the end of the touch detecting operation process.

In Step S46, the first counter 54 counts up the VC to continue adding the VC in the counter memory 56.

Referring back to FIG. 16, in Step S47, the controller 51 judges whether the ST value in the counter memory 56 is "6." If the ST value is "6," it is judged as YES in Step S47 and the processing shifts to Step S48. If the ST value is not "6," it is judged as NO in Step S47 and the processing shifts to Step S51. Processes in Step S51 and its following steps will be described later.

In Step S48, the controller 51 judges whether the second contact point off signal has been received. If the second contact point off signal has been received, it is judged as YES in Step S48 and the processing shifts to step S49. If the second contact point off signal has not been received, it is judged as NO in Step S48 and the processing shifts to step S50. Processes in Step S50 and its following steps will be described later.

As shown in FIG. 17, in Step S49, the controller 51 judges whether the first contact point off signal has been received. If the first contact point off signal has been received, it is judged as YES in Step S49 and the processing shifts to Step S38. If the first contact point off signal has not been received, it is judged as NO in Step S49 and the processing shifts to Step S46.

As shown in FIG. 16, in Step S50, the status increase circuit 53 sets the ST to "5," thereby updating the ST value in the counter memory 56 to "5."

Figure 19:
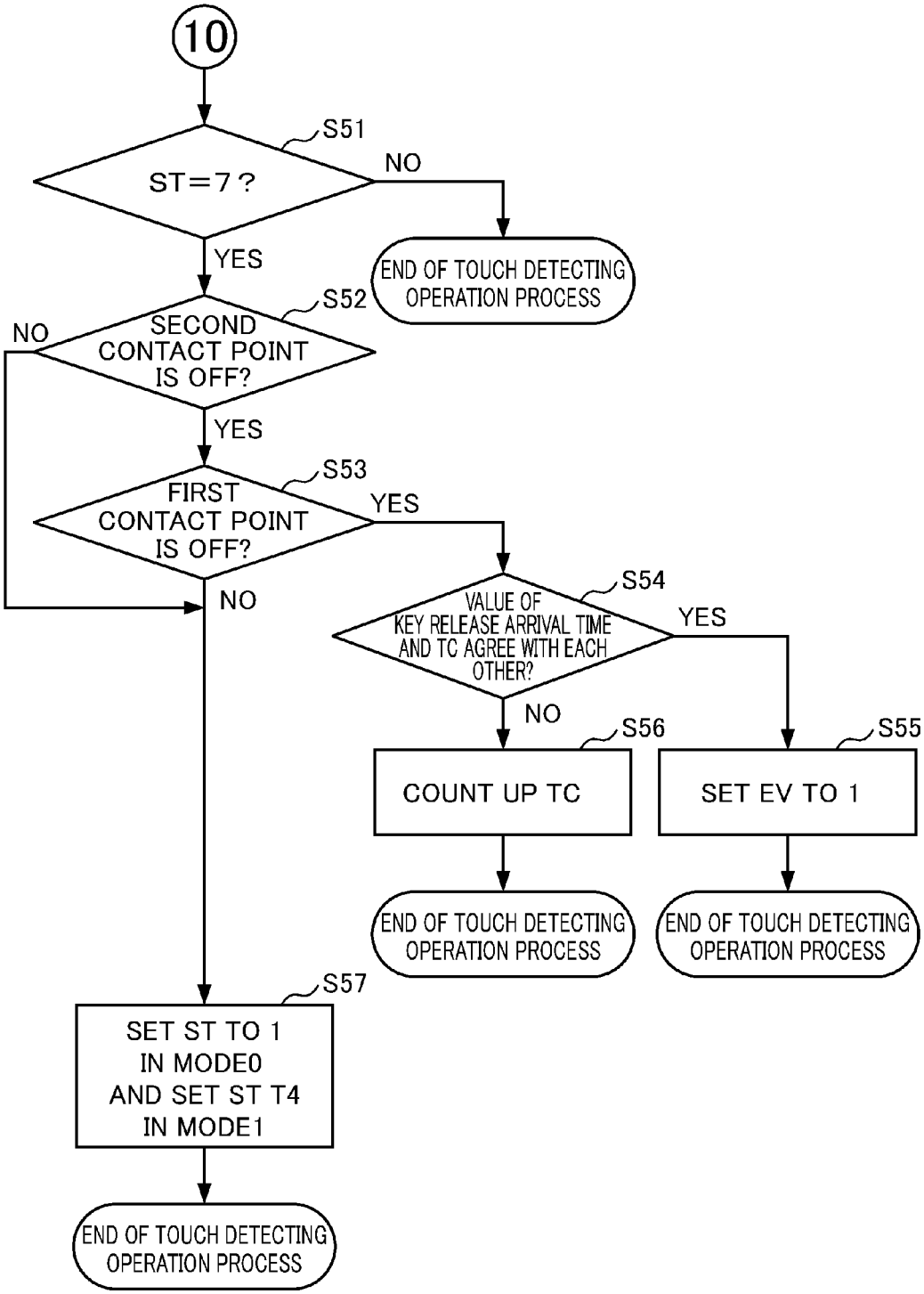
FIG. 19 is a flowchart showing the flow of the touch detecting operation process by the touch detection apparatus of FIG. 2.

As shown in FIG. 19, in Step S51, the controller 51 judges whether the ST value in the counter memory 56 is "7." If the ST value is "7," it is judged as YES in Step S51 and the processing shifts to Step S52. If the ST value is not "7," it is judged as NO in Step S51 and the touch detecting operation process is finished.

In Step S52, the controller 51 judges whether the second contact point off signal has been received. If the second contact point off signal has been received, it is judged as YES in Step S52 and the processing shifts to Step S53. If the second contact point off signal has not been received, it is judged as NO in Step S52 and the processing shifts to Step S57. Processes in Step S57 and its following steps will be described later.

In Step S53, the controller 51 judges whether the first contact point off signal has been received. If the first contact point off signal has been received, it is judged as YES in Step S53 and the processing shifts to Step S54. If the first contact point off signal has not been received, it is judged as NO in Step S53 and the processing shifts to Step S57. Processes in Step S57 and its following steps will be described later.

In Step S54, the comparator circuit 58 compares the damper-on time in the second arrival time memory 57*b* and the TC in the counter memory 56 to judge whether the damper-on time and the TC agree with each other. If the damper-on time and the TC are judged as agreeing with each other, it is judged as YES in Step S54 and the processing shifts to Step S55. If the damper-on time and the TC are judged as not agreeing with each other, it is judged as NO in Step S54 and the processing shifts to Step S56. Processes in Step S56 and its following steps will be described later.

In Step S55, the EV flag set circuit 52 sets the EV to "1," thereby updating the EV value in the counter memory 56 to "1." Finishing this process means the end of the touch detecting operation process.

In Step S56, the second counter 55 counts up the TC to continue adding the TC in the counter memory 56. Finishing this process means the end of the touch detecting operation process.

In Step S57, if a mode is "mode0," the status increase circuit 53 sets the ST to "1," thereby updating the ST value in the counter memory 56 to "1." In Step S57, if a mode is "mode1," the status increase circuit 53 sets the ST to "4," thereby updating the ST value in the counter memory 56 to "4." Finishing this process means the end of the touch detecting operation process.

As described above, the touch detection apparatus 50 of the present embodiment is for an electronic musical instrument including: multiple keys to which sound pitches of corresponding types are associated; the first and second contact points 160*a* and 160*b* provided for each of the keys, the first and second contact points 160*a* and 160*b* being turned on or off in order in positions in which a press amount of each key differs from each other in response to key pressing action or key releasing action; the CPU 11 functioning as a sound generation control unit to generate a sound of a given type in response to a note-on event; and the CPU 11 functioning as a sound deadening control unit to deaden a sound of a given type in response to a note-off event or a damper-on event (note-off event). The touch detection apparatus 50 includes the first counter 54, the controller 51, the second counter 55, and the comparator circuit 58.

The first counter 54 counts a period of time from when the second contact point 160*b* is turned off until when the first contact point 160*a* is turned off based on respective off detection signals about the first and second contact points 160*a* and 160*b*.

The controller 51 predicts the damper-on arrival time as time of arrival of generation of a damper-on event (note-off event) based on the period of time counted by the first counter 54 from when the second contact point 160*b* is turned off until when the first contact point 160*a* is turned off.

The second counter 55 counts time to be compared to the damper-on arrival time.

The comparator circuit 58 compares the time counted by the second counter 55 and the damper-on arrival time. If the time counted by the second counter 55 and the damper-on arrival time agree with each other, the comparator circuit 58 transmits the key release agreement signal triggering generation of a damper-on event (note-off event) to the controller 51.

If the key release agreement signal is transmitted from the comparator circuit 58, the controller 51 executes control to generate a damper-on event (note-off event).

In this way, the damper-on arrival time is predicted with two contact points (switches) including the first and second contact points 160*a* and 160*b*. Thus, a note-off event can be generated in any position that can be determined based on a difference between times when the two contact points are turned off. This achieves performance relating to repetition of the same sound and a trill with only two contact points comparable to those achieved by an electronic piano with three contact points, thereby enabling control of overlap of various sounds. Predicting the key release arrival time with only two contact points (switches) eliminates the need for a contact point (switch) or a circuit dedicated to detection of key release timing, thereby contributing to cost reduction.

If respective on detection signals about the first and second contact points 160*a* and 160*b* are supplied before the key release agreement signal is transmitted from the comparator circuit 58, the controller 51 of the touch detection apparatus 50 of the present embodiment executes control to prohibit generation of a damper-on event (note-off event) and generate a note-on event.

As a result, by placing the first contact point 160*a* in a deep stroke position, repetition and a trill of a small stroke amplitude in the deep position can be made with only two contact points, like in an electronic piano with three contact points. This allows achievement of performance relating to repetition comparable to that achieved by the electronic piano with three contact points.

The touch detection apparatus 50 of the present embodiment has at least multiple modes that enable selection of the presence or absence of generation of a note-on event. Based on selected one of these modes, the controller 51 controls the presence of absence of generation of a note-on event.

As a result, various performances relating to repetition can be achieved based on a mode selected according to a user's request.

The touch detection apparatus 50 of the present embodiment has at least a mode in which a note-off event is generated in response to turning off the first contact point 160*a*. If this mode is selected, the controller 51 controls generation of a note-off event in response to supply of an off detection signal about the first contact point 160*a*.

As a result, based on a mode selected according to a user's request, a sound can be deadened immediately upon turning off the first contact point 160*a*.

The first counter 54 of the touch detection apparatus 50 of the present embodiment counts a period of time from when the first contact point 160*a* is turned on until when the second contact point 160*b* is turned on based on respective on detection signals about the first and second contact points 160*a* and 160*b*. The second counter 55 counts time to be compared to the key press arrival time as time of arrival of generation of a note-on event.

The comparator circuit 58 compares the time counted by the second counter 55 and the key press arrival time. If the time counted by the second counter 55 and the key press arrival time agree with each other, the comparator circuit 58 transmits the key press agreement signal triggering generation of a note-on event to the controller 51. If the key press agreement signal is transmitted from the comparator circuit 58, the controller 51 executes control to generate a note-on event.

Thus, a note-on event can be generated in any position that can be determined based on a difference between times when the two contact points are turned on.

This achieves performance relating to repetition of the same sound and a trill with only two contact points comparable to those achieved by an electronic piano with three contact points.

In the touch detection apparatus 50 of the present embodiment, the first counter 54 functions both as a counter to count a period of time from when the second contact point 160*b* is turned off until when the first contact point 160*a* is turned off and as a counter to count a period of time from when the first contact point 160*a* is turned on until when the second contact point 160*b* is turned on.

This enables count of both the key release velocity measured value and the key press velocity measured value with only one counter (first counter 54), contributing to reduction in parts count and cost reduction.

The touch detection apparatus 50 of the present embodiment has at least a mode in which a note-on event is generated in response to turning on the second contact point 160*b*. If this mode is selected, the controller 51 controls generation of a note-on event in response to supply of an on detection signal about the second contact point 160*b*.

As a result, based on a mode selected according to a user's request, a sound can be generated immediately upon turning on the second contact point 160*b*. Thus, a sound of a corresponding tone can be generated to comply with optimum timing.

If a prescribed condition is satisfied, instead of using a result of prediction by the controller 51, the comparator circuit 58 of the touch detection apparatus 50 of the present embodiment uses fixed time as the damper-on arrival time.

As a result, the damper-on arrival time can be fixed regardless of a period of time from when the second contact point

160*b* is turned off until when the first contact point 160*a* is turned off, thereby suppressing sound variations with time.

It should be noted that the present invention is not to be limited to the aforementioned embodiment, and that modifications, improvements, etc. within a scope that can achieve the object of the present invention are also included in the present invention.

As an example, in the aforementioned embodiment, there are 88 keys and 88 specific addresses in the counter memory. This is given only for illustration. Any number of specific addresses can be prepared in the counter memory as long as this number does not fall below the number of keys, for example.

In the aforementioned embodiment, both the counter memory 56 and the arrival time memory 57 are provided. This is given only for illustration. As an example, one memory including the counter memory 56 and the arrival time memory 57 may be provided.

In the aforementioned embodiment, the content in the counter memory 56 is obtained by measurement. This is given only for illustration. As an example, the content in the counter memory 56 can be one changed in a latter stage. If a counter value (measured value) obtained by each counter is stored in the counter memory 56 and the stored count value is referred to as an off-velocity, a control circuit can change the damper-on arrival time, specifically a stroke position by rewriting the value in the counter memory 56.

The counter memory 56 can also be responsive to the specifications of changing a keyboard setting according to a tone or user's preference. Specifically, if there are multiple counter memories 56 responsive to multiple corresponding tone parameters, the control circuit can predict the damper-on arrival time based on the content in a counter memory responsive to designated one of these tone parameters. This enables prediction of the key release arrival time in response to various tones, so that a sound peculiar to a corresponding tone can be expressed.

In the aforementioned embodiment, an electronic piano is described as an example of the electronic musical instrument to which the touch detection apparatus according to the present invention is applied. However, this is not given as a particular limitation.

The present invention is applicable for example to general electronic equipment having a touch detecting function. More specifically, the present invention is applicable for example to notebook-sized personal computers, printers, television receivers, video cameras, portable navigation apparatuses, portable phones, and portable game machines.

In other words, the hardware structure of FIG. 1 is given only for illustration but not for particular limitation.

The embodiments of the present invention described so far are only illustrative and are not to limit the technical scope of the present invention. Various other embodiments can be applied to the present invention. Additionally, these embodiments can be changed in any way by means of omission or replacement without departing from the substance of the present invention. These embodiments or modifications thereof are within the scope and the substance of the invention described in this specification, and within the invention recited in the scope of claims and within a scope equivalent to this invention.

What is claimed is:

1. An electronic musical instrument comprising a touch detection apparatus that comprises: a keyboard with multiple keys that designate the tones of corresponding musical sounds to be generated;

a first contact point provided for each of the keys, the first contact point being turned on if a press amount increases to a first value in response to key pressing action on this key, the first contact point being turned off if the press amount decreases to a value below the first value in response to key releasing action on the key;

a second contact point that is turned on if the press amount of the key increases further to a second value larger than the first value in response to the key pressing action, the second contact point being turned off if the press amount decreases to a value below the second value in response to the key releasing action;

a key press counter that counts a period of time from when the first contact point is turned on until when the second contact point is turned on in response to the key pressing action;

a note-on event generation unit, in response to turning on the second contact point, the note-on event generation unit generating a note-on event to instruct generation of a musical sound of a volume corresponding to the period of time counted by the key press counter and of a pitch corresponding to the pressed key;

a key release counter that counts a period of time from when the second contact point is turned off until when the first contact point is turned off in response to the key releasing action; and a note-off event generation unit, after elapse of time corresponding to a count value in the key release counter from turning off the first contact point, the note-off event generation unit generating a note-off event to instruct deadening of a musical sound of a pitch corresponding to the released key, the electronic musical instrument comprising a sound source that generates a musical sound and deadens a musical sound based on the note-on event and the note-off event generated by the touch detection apparatus.

2. The electronic musical instrument according to claim 1, wherein the touch detection apparatus further comprises:

a judgment unit that judges whether the first contact point is turned on again before the note-off event is generated by the note-off event generation unit; and a control unit, if the judgment unit judges that the first contact point is turned on again, the control unit executing control to make the note-on event generation unit generate a new note-on event to instruct generation of a musical sound of a pitch corresponding to the pressed key when the second contact point is turned on without making the note-off event generation unit generate the note-off event.

3. The electronic musical instrument according to claim 1, wherein the touch detection apparatus further makes the note-off event generation unit generate a new note-off event to instruct deadening of a musical sound of a pitch corresponding to the released key when the first contact point is turned off in response to the key releasing action.

4. The electronic musical instrument according to claim 1, wherein the note-on event generation unit generates the note-on event after elapse of the time corresponding to the count value in the key press counter.

5. The electronic musical instrument according to claim 4, wherein the note-on event generation unit generates the note-on event when the second contact point is turned on.

6. A touch detecting method executed by an electronic musical instrument comprising a touch detection apparatus that comprises: a keyboard with multiple keys that designate the tones of corresponding musical sounds to be generated; a first contact point provided for each of the keys, the first contact point being turned on if a press amount increases to a first value in response to key pressing action on this key, the first contact point being turned off if the press amount decreases to a value below the first value in response to key releasing action on the key; and a second contact point that is turned on if the press amount of the key increases further to a second value larger than the first value in response to the key pressing action, the second contact point being turned off if the press amount decreases to a value below the second value in response to the key releasing action, the electronic musical instrument comprising a sound source that generates a musical sound and deadens a musical sound based on a note-on event and a note-off event generated by the touch detection apparatus, wherein the electronic musical instrument counts a period of key press time from when the first contact point is turned on until when the second contact point is turned on in response to the key pressing action, in response to turning on the second contact point, the electronic musical instrument generates a note-on event to instruct generation of a musical sound of a volume corresponding to the counted period of key press time and of a pitch corresponding to the pressed key, the electronic musical instrument counts a period of key release time from when the second contact point is turned off until when the first contact point is turned off in response to the key releasing action, and after elapse of time corresponding to the counted period of key release time from turning off the first contact point, the electronic musical instrument generates a note-off event to instruct deadening of a musical sound of a pitch corresponding to the released key.

7. The touch detecting method according to claim 6, wherein the touch detection apparatus judges whether the first contact point is turned on again before the note-off event is generated, and if the first contact point is judged as being turned on again, the touch detection apparatus executes control to generate a new note-on event to instruct generation of a musical sound of a pitch corresponding to the pressed key when the second contact point is turned on without generating the note-off event.

8. The touch detecting method according to claim 6, wherein the touch detection apparatus further generates a new note-off event to instruct deadening of a musical sound of a pitch corresponding to the released key when the first contact point is turned off in response to the key releasing action.

9. The touch detecting method according to claim 6, wherein the touch detection apparatus generates the note-on event after elapse of the period of key press time.

10. The touch detecting method according to claim 9, wherein the touch detection apparatus generates the note-on event when the second contact point is turned on.

11. A non-transitory computer-readable storage medium storing a program that makes a computer used as an electronic musical instrument execute the following steps, the electronic musical instrument comprising a touch detection apparatus that comprises: a keyboard with multiple keys that designate the tones of corresponding musical sounds to be generated; a first contact point provided for each of the keys, the first contact point being turned on if a press amount increases to a first value in response to key pressing action on this key, the first contact point being turned off if the press amount decreases to a value below the first value in response to key releasing action on the key; and a second contact point that is turned on if the press amount of the key increases further to a second value larger than the first value in response to the key pressing action, the second contact point being turned off if the press amount decreases to a value below the second value in response to the key releasing action, the electronic musical instrument comprising a sound source that generates a musical sound and deadens a musical sound based on a note-on event and a note-off event generated by the touch detection apparatus, the steps comprising:

a step of counting a period of key press time from when the first contact point is turned on until when the second contact point is turned on in response to the key pressing action;

a step of generating a note-on event to instruct generation of a musical sound of a volume responsive to the counted period of key press time and of a pitch corresponding to the pressed key, the note-on event being generated in response to turning on the second contact point;

a step of counting a period of key release time from when the second contact point is turned off until when the first contact point is turned off in response to the key releasing action; and a step of generating a note-off event to instruct deadening of a musical sound of a pitch corresponding to the released key, the note-off event being generated after elapse of time corresponding to the counted period of key release time from turning off the first contact point.

12. The storage medium according to claim 11 that stores the program that further makes the computer execute: a step of judging whether the first contact point is turned on again before the note-off event is generated; and a step of executing control to generate a new note-on event to instruct generation of a musical sound of a pitch corresponding to the pressed key when the second contact point is turned on without generating the note-off event, the control being executed if the first contact point is judged as being turned on again in the step of the judgment.

13. The storage medium according to claim 11 that stores the program that further makes the computer execute: a step of generating a new note-off event to instruct deadening of a musical sound of a pitch corresponding to the released key when the first contact point is turned off in response to the key releasing action.

14. The storage medium according to claim 11, wherein in the step of generating the note-on event, the note-on event is generated after elapse of the period of key press time.

15. The storage medium according to claim 14, wherein in the step of generating the note-on event, the note-on event is generated when the second contact point is turned on.

16. A touch detection apparatus comprising: a first contact point provided for each key that designates the tone of a corresponding musical sound to be generated, the first contact point being turned on if a press amount increases to a first value in response to key pressing action on this key, the first contact point being turned off if the press amount decreases to a value below the first value in response to key releasing action on the key;

a second contact point that is turned on if the press amount of the key increases further to a second value larger than the first value in response to the key pressing action, the second contact point being turned off if the press amount decreases to a value below the second value in response to the key releasing action;

a key press counter that counts a period of time from when the first contact point is turned on until when the second contact point is turned on in response to the key pressing action;

a note-on event generation unit, in response to turning on the second contact point, the note-on event generation unit generating a note-on event to instruct generation of a musical sound of a volume corresponding to the period of time counted by the key press counter and of a pitch corresponding to the pressed key;

a key release counter that counts a period of time from when the second contact point is turned off until when the first contact point is turned off in response to the key releasing action; and a note-off event generation unit, after elapse of time corresponding to a count value in the key release counter from turning off the first contact point, the note-off event generation unit generating a note-off event to instruct deadening of a musical sound of a pitch corresponding to the released key.

* * * * *